US006953513B1

(12) United States Patent
Volkert

(10) Patent No.: US 6,953,513 B1
(45) Date of Patent: Oct. 11, 2005

(54) METHOD OF MAKING MAGAZINES INCORPORATING POP-UPS AND STRIP FOR USE THEREWITH

(76) Inventor: John K. Volkert, P.O. Box 8060, Wilmette, IL (US) 60091

( * ) Notice: Subject to any disclaimer, the term of this patent is extended or adjusted under 35 U.S.C. 154(b) by 1 day.

(21) Appl. No.: 10/627,242

(22) Filed: Jul. 25, 2003

Related U.S. Application Data

(63) Continuation-in-part of application No. 09/906,940, filed on Jul. 16, 2001, now abandoned.

(60) Provisional application No. 60/288,604, filed on May 3, 2001.

(51) Int. Cl.[7] ..... B32B 31/10; B32B 31/18

(52) U.S. Cl. ..... 156/256; 156/264; 156/277; 156/289

(58) Field of Search ..... 270/39.09, 52.13, 270/52.09, 58.01, 58.04, 5.02, 11, 12, 15–17, 270/20.1, 21.1, 32, 39.01, 39.04, 39.07; 156/247–250, 156/253, 256, 260, 263, 264, 277, 289; 283/33, 283/63.1; 40/124.08, 124.14, 360, 630, 539, 40/530

(56) References Cited

U.S. PATENT DOCUMENTS

| | | | | | |
|---|---|---|---|---|---|
| 2,309,244 | A | | 1/1943 | Fey | 281/38 |
| 3,995,388 | A | | 12/1976 | Penick et al. | 40/126 A |
| 4,163,548 | A | | 8/1979 | Nystrand | 270/39 |
| 4,212,231 | A | | 7/1980 | Penick et al. | 93/1 |
| 4,337,589 | A | | 7/1982 | Volkert et al. | 40/124 |
| 4,408,755 | A | * | 10/1983 | Meier | 270/52.09 |
| 4,842,303 | A | * | 6/1989 | Molenda | 281/38 |
| 4,867,480 | A | | 9/1989 | Volkert | 283/117 |
| 5,022,681 | A | | 6/1991 | Penick | 281/15.11 |
| 5,582,888 | A | * | 12/1996 | Volkert | 428/40.1 |
| 6,044,490 | A | | 4/2000 | Volkert et al. | 2/12 |
| 6,068,903 | A | | 5/2000 | Volkert | 428/40.1 |
| 6,301,813 | B1 | | 10/2001 | Volkert | 40/124.08 |

* cited by examiner

*Primary Examiner*—Chris Fiorilla
*Assistant Examiner*—Sing P. Chan
(74) *Attorney, Agent, or Firm*—Fitch, Even, Tabin & Flannery

(57) ABSTRACT

Methods for making magazines that incorporate pop-up structures formed from two facing pages of the magazine and a strategically placed pop-up piece that is adhesively affixed to both facing pages so as to open into an attention-attracting three-dimensional configuration when the magazine is opened to those two pages. The methods are efficient, economical and well adapted to high speed production using a novel integral continuous strip of pop-up pieces arranged end-to-end, and accordingly, the distribution of magazines incorporating three-dimensional pop-up structures becomes a reality.

17 Claims, 24 Drawing Sheets

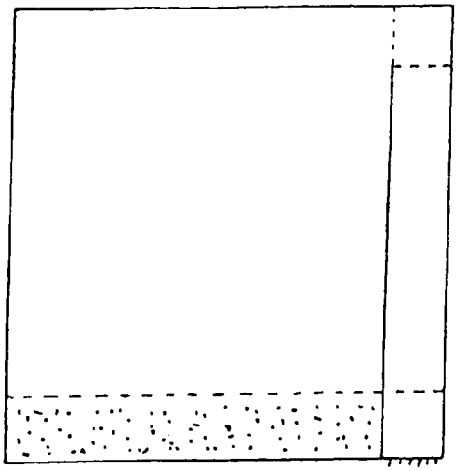
FIG. 1
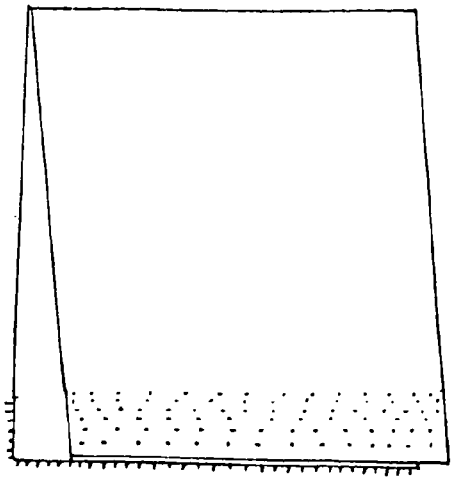
FIG. 2
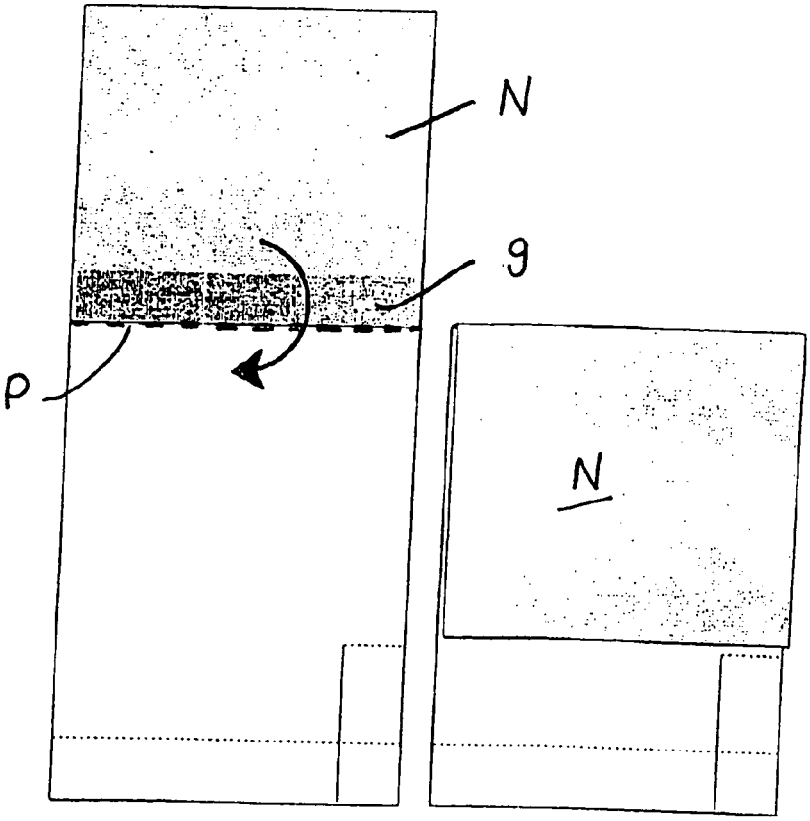
FIG. 7A
FIG. 7B

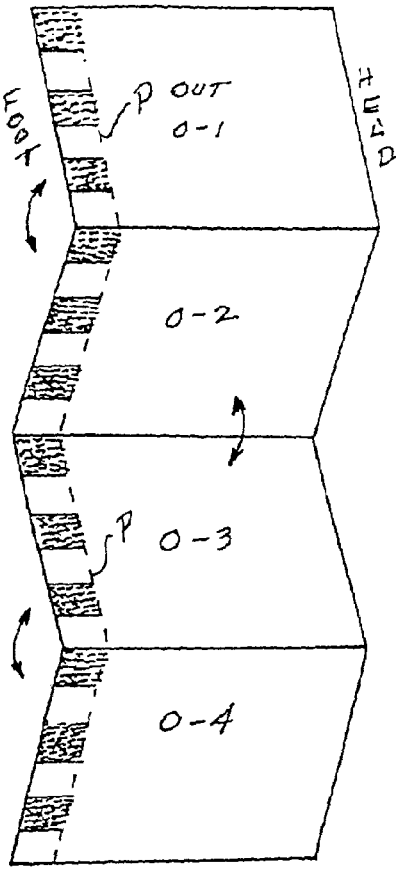
FIG. 13 A
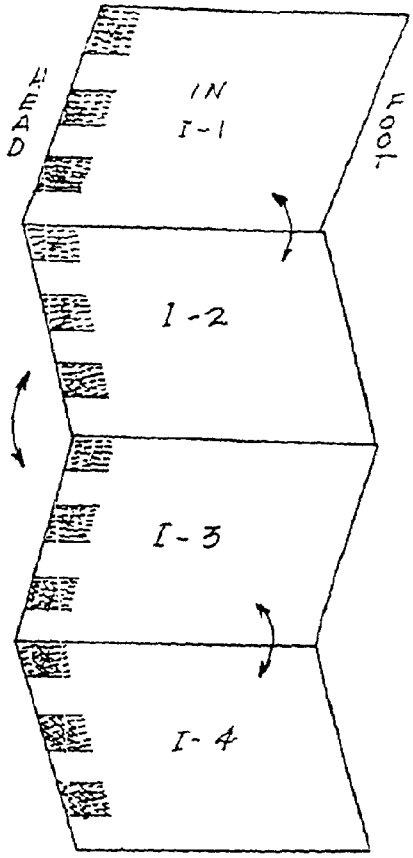
FIG. 13 B
FIG. 13
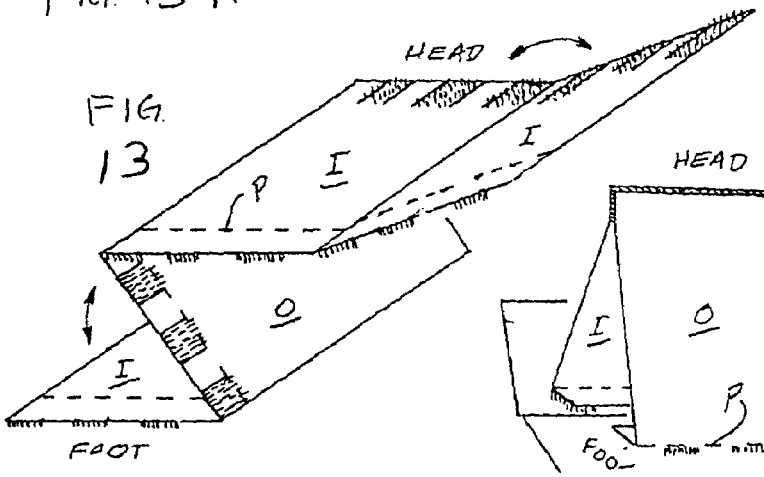
FIG 13C
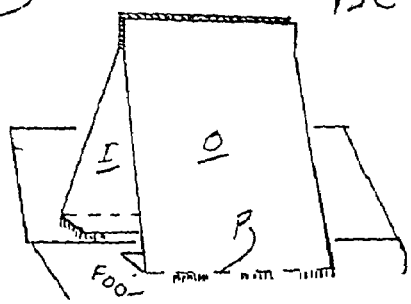

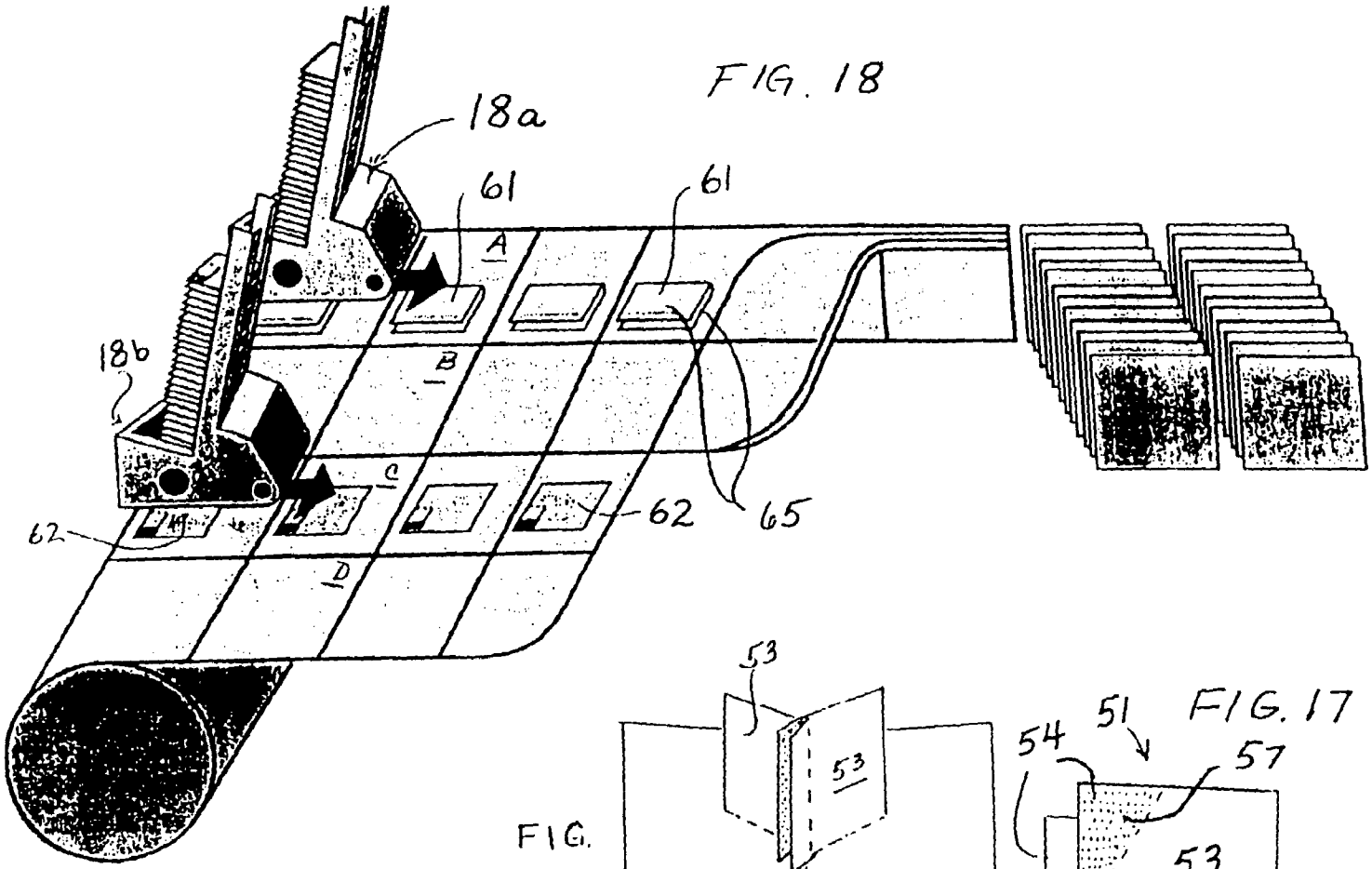
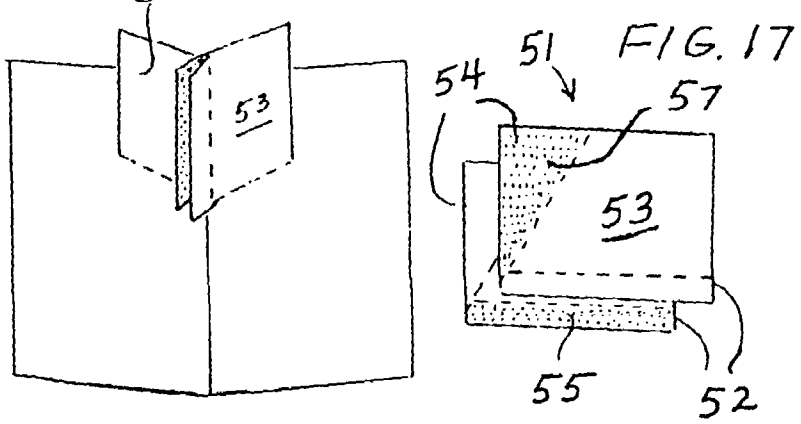
FIG. 17A

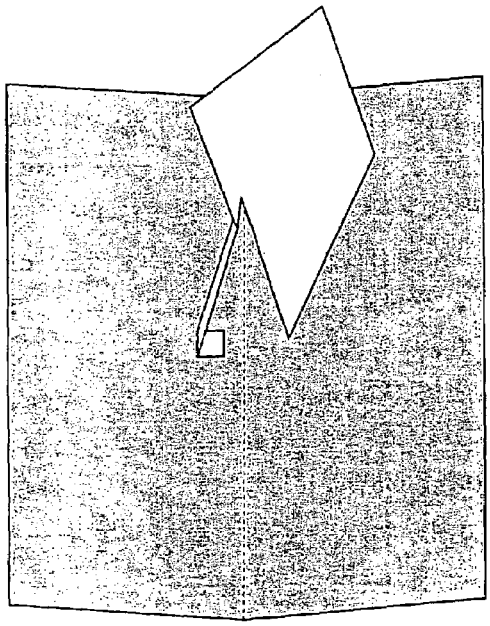
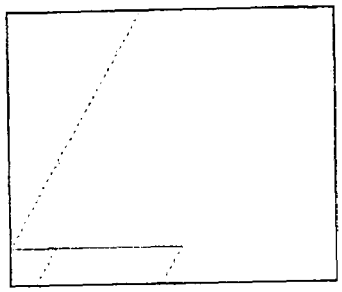
FIG. 22
FIG. 22 A
FIG. 21 A
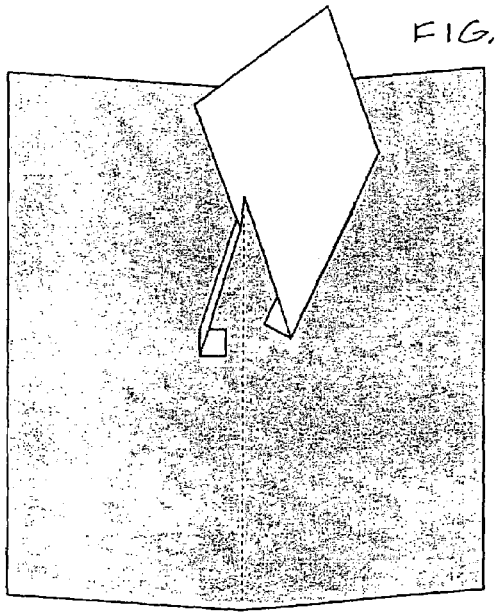
FIG. 21
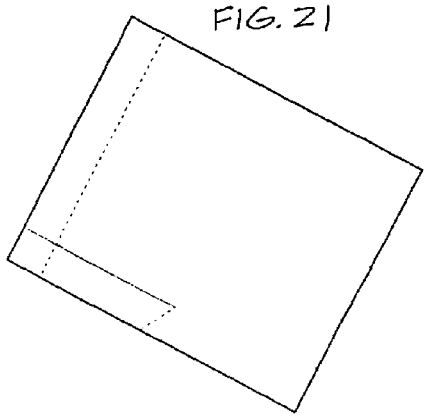

Figure 27
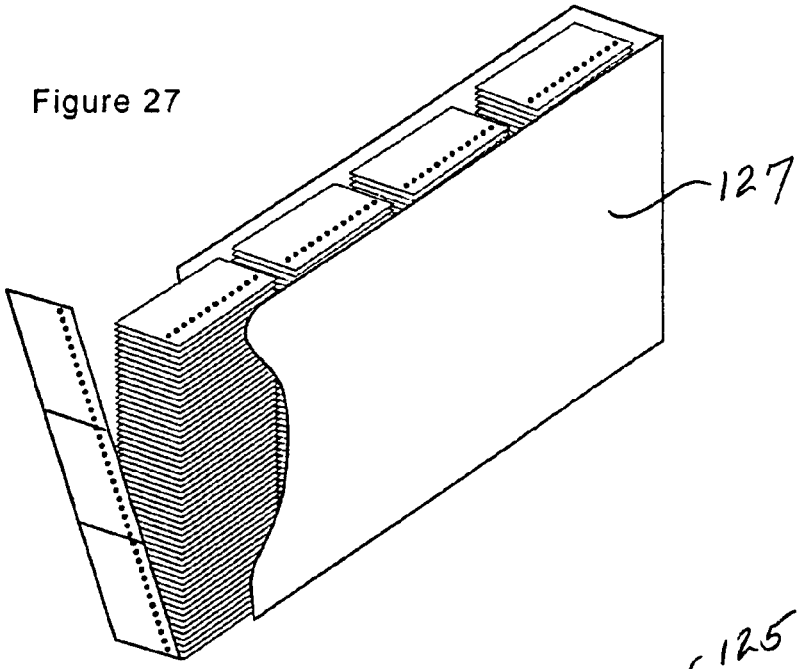
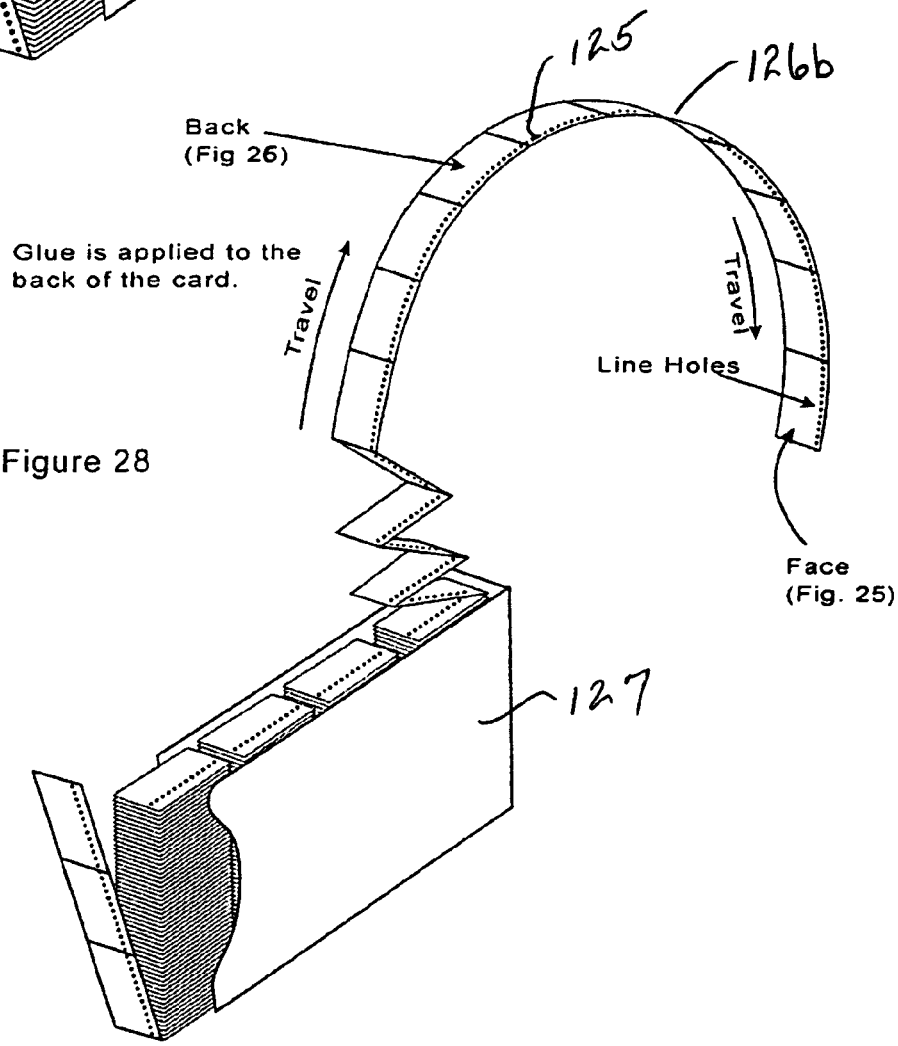
Figure 28

METHOD OF MAKING MAGAZINES INCORPORATING POP-UPS AND STRIP FOR USE THEREWITH

This application is a continuation-in-part of U.S. Ser. No. 09/906,940, filed Jul. 16, 2001 now abn, which application claims priority from U.S. provisional application Ser. No. 60/288,604, filed May 3, 2001.

This application relates to the production of magazines from printed sheet material and more particularly to magazine production wherein pop-up pieces are economically combined with magazine pages to form a pop-up structure that provides a three-dimensional configuration between facing pages.

BACKGROUND OF THE INVENTION

Flat sheets of paper have been used for a long time in many ways. As a desire for unique uses emerged, sheets of paper were glued together to create 3 dimensional effects. Originally this was done by hand, some of the initial uses were for displays, books and greeting cards. As the popularity developed, these items became known as pop-ups. This was believed to be because the item consisted of two or more sheets glued together and then further glued into front and back sheets, often the front and back sheets were one sheet that was folded and called a cover. By opening the cover, the sheets glued inside would surprisingly erect, popping up into three-dimension. Thus the cover, and the geometrically positioned sheets glued inside, became known as "a pop-up."

Initially, the construction of pop-ups was done by hand. This gradually changed, becoming a combination of hand and machine assembly, with the pop-up pieces being glued together and then to each panel of the cover containing them. Further development enabled complete assembly by machine. Although this was more cost effective, it limited the intricacy of the designs of the die-cut pop-up elements that might be glued to the cover sheets. Certain-die cut designs have a tendency to break when conveyed at high speed. Also the exposed adhesive, inherent on such pop-up elements, had to be quickly covered by the front and back covers so as not to come into contact with press parts on inline web presses. Generally cover sheets were necessary to prevent the adhesive from erroneously offsetting or bonding to the wrong substrate. Even with the limitations, this advancement makes it currently feasible to place such covered pop-up constructions into magazines as a separate add-on insert. Because of the number of components of the pop-up, i.e., a front and back cover plus one or more pop-up sheets glued to the covers, it has not been feasible to print the present style pop-up jointly with magazines at the high speed at which magazines are produced. As a resulted, pre-printed and pre-assembled pop-ups were required that might then be added during the final binding of the magazines, as binding speeds were more compatible to such additions.

Because of the foregoing, although the pop-up in magazines has been significant, sales have been mostly limited to users with large advertising budgets. One reason for this is because, instead of paying "Run of Publication" single page advertising rates, the advertising rates charged for a separate insert include charges for the 4-page cover as well as the pop-up therewithin because they interrelate. This is significantly more than the charge for a one-page or a two-page spread of "Run of Publication." In addition, further costs are added to prepare the correct binding means to enable the interrelated 4-page cover pop-up insert to be bound into the magazine or added to a mailer, e.g. a bindery "hanger" for saddle-stitch binding, or a binding "strip" for perfect binding. FIGS. 23 and 24 illustrate ways that an interrelated 4-page cover and pop-up element have been previously inserted into magazines prior to the present invention. FIG. 23 illustrates a 4-page cover having a binding strip S attached to the outer surface of one page of the signature for insertion into a perfect-bound magazine. FIG. 24 illustrates an interrelated 4-page cover and pop-up insert (element) with a binding hangar H attached to the outer surface of one page of the cover to facilitate insertion into a saddle-stitched magazine. Also, insertion into a magazine using such a concept was limited to specific positions.

Present-day magazine circulation in the U.S. reaches extremely large audiences and, as a result, has become a popular way to advertise. However, as magazine advertising has proliferated, so many ads are carried in a single magazine volume that, after a while, the reader sees all of them as blending into one another. Accordingly, advertisers have striven to incorporate some distinctiveness into their magazine advertising and have occasionally attached coupons or return mail cards to a page of their advertising. However, such efforts have met with varying success as such cards and coupons lie flat against the sheet itself and frequently go unnoticed by the reader. As the demand for cost effectiveness has become greater, it is necessary to have a design concept constructed so that it is capable of being conveyed at high speeds in a continuous configuration. It should have proper paper tensile strength and die-cutting with adhesive positioning that will only bond with the acceptable areas of the substrate. It should not sever due to weakness caused by improperly designed die-cutting. Accordingly, new ideas in magazine advertising continue to be sought.

BRIEF SUMMARY OF THE INVENTION

It has now been determined that pop-up structures can be effectively created during the high speed production of magazines. It has become feasible to economically produce and install pop-up pieces so they bridge two facing pages of a magazine so that, when the reader turns to that page, the pop-up piece springs into attention-attracting three-dimensional shape. The result is that the reader is much more likely to peruse that particular advertisement because his or her attention has been drawn to it.

The present invention provides a single sheet dimensional pop-up design that is constructed so it can be combined with printed sheets, such as magazines or other component forms, during the printing of those elements on a high speed web press. This pop-up design can be pre-printed before being added to the sheet or can be printed during the process of being added to the sheet when the sheet is being printed, which has not previously been done. The design format is new, unique and versatile and creates a pop-up that can be positioned to align with a desired related magazine ad page in different publications even though the pagination of the same specific ad varies from publication to publication. The versatility of this production method which employs such a single sheet pop-up construction is that the pop-up can exist solely as an ad by itself or it can also relate to either a portion of a page, the whole page, both pages on each side of the binding spine, or portions of both pages to which it attaches.

The improvement presented here eliminates a very significant amount of production time, material cost and advertising space costs. All of this adds up to a very, very sizeable reduction in total cost, 50 to 80% depending on how the improvement is used. It is possible to have a sheet assemblage with the advertising rate for the location of the pop-up piece to be just the rate for a "half page" plus a percent of that for the dimensional pop-up piece. The cost of such a magazine pop-up structure is significantly less than the current rate charged for a 4-page cover and pop-up plus the cost of facilitating binding means.

BRIEF DESCRIPTION OF THE DRAWINGS

FIGS. 1 and 2 show single sheet and folded pop-up pieces respectively.

FIGS. 7A and 7B show an alternative embodiment of a pop-up piece similar to that shown in FIG. 1.

FIGS. 13 through 13C show Z-folded arrangements as generally shown in FIG. 5 of pop-up pieces of the general type illustrated in FIG. 2.

FIGS. 17 and 17A are views similar to FIGS. 16 and 16A showing an alternative embodiment of a pop-up piece.

FIG. 18 is a diagrammatic perspective view showing the placement of two pop-up pieces onto multiple signatures that are adjacent to each other as a part of a web fed press arrangement to form magazine pop-up structures.

FIGS. 21 and 21A show an alternative embodiment a pop-up piece such as that depicted in FIG. 1 in flat form and then in three-dimensional configuration as a pop-up structure in association with the open facing pages of a magazine.

FIGS. 22 and 22A show another alternative embodiment of a single sheet pop-up piece similar to that shown in FIGS. 21 and 21A and the resultant pop-up structure.

FIG. 27 is a perspective view showing the boxing of attached units of the pieces shown in FIGS. 25 and 26.

FIG. 28 is a schematic perspective view showing the feeding of the boxed attached items of FIG. 27.

DETAILED DESCRIPTION OF THE PREFERRED EMBODIMENTS

Figure 3:
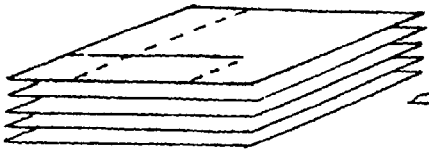
FIGS. 3 and 4 show how the pop-up pieces of FIGS. 1 and 2 might be arranged in stacks from which they might be delivered to magazine pages being produced.

Shown in the drawings are a number of ways this improvement can be achieved. The pop-up piece can be added as part of the sheet assemblage as the high speed web sheets are being printed; for example, pop-up pieces can be attached to the sheet assemblage as it is being conveyed at high speed for purposes of mailing, binding or just collating.

In most instances, the pop-up piece is a flat single sheet, or a flat folded sheet for cost efficiencies constructed to achieve the attention-getting attribute that has made these pop-up structures popular. Instead of being just a flat sheet and possibly unrelated to the page onto which it has been fed, it can be specifically related to targeted pages; it changes from a flat sheet configuration into an attention-attracting three-dimensional configuration, just as would a larger, much more costly combination of a separate 4-page cover plus pop-up piece. However, it can be produced at a much more cost-efficient rate. Thus, with this improvement and the lower costs available, the number of customers that can now economically avail themselves of the benefits of such pop-up structures is significantly increased.

The pop-up piece can carry adhesive prior to its being added to the sheet assemblage, or it can have adhesive applied either to it or to the sheet assemblage as the pop-up piece is being added to the sheet assemblage. Moreover, additional adhesive may be thereafter added to it or to a facing page but such is not preferred. Any suitable adhesive of the variety of adhesives available may generally be used. Co-adhesives may also be employed, but such are felt to be less desirable because of the necessity to apply them to both surfaces. In this respect, the adhesives can be dry residue, latent adhesive, fugitive adhesive, pressure-sensitive adhesive or any of the varieties of permanent adhesives.

As shown in the drawings, there are different means of feeding the various designs of pop-up pieces such as from stacks, rolls, et cetera. Certain types of feeding equipment are shown as examples, and others are known in this art. Also, pop-up pieces may be attached to one another and then separated at feeding or may be attached to a "liner" to be removed during feeding.

Pop-up structures have commonly included a central die-cut flat sheet that is sandwiched between and attached to the interrelated facing pages of the wrap and that opens into a three-dimensional configuration when an interrelated outer folded basepiece or wrap, sometimes referred to as a 4-page cover, is opened. Although two such sheets may be joined along a "false backbone" to create such a wrap, commonly one sheet is folded to create a hinge line so that halves of the sheets are brought into face-to-face orientation with the die-cut pop-up piece being attached to specific areas of the folded sheet on opposite sides of the hinge line. An interrelated 4-page wrap plus pop-up piece might be inserted into a magazine as a completed composite structure with the die-cut sheet having been earlier secured within the wrap, for example. Depending upon the type of binding being used to construct the magazine, e.g. saddle-stitch, perfect-binding, etc., an appropriate arrangement must be provided to enable binding of the interrelated composite structure into the magazine in a fashion so that it will be opened by the reader in a proper fashion to activate the pop-up piece.

It has now been determined that either a single flat die-cut sheet (see FIG. 1) or a folded flat sheet (see FIG. 2) can be effectively fed onto magazine pages as a part of a high speed printing or binding operation to create pop-up structures wherein the independent facing magazine pages take the place of the interrelated 4-page cover mentioned above. Other 2-ply flat non-folded pieces may also be used, see FIGS. 13 and 17. As a result, the sheet material pop-up piece rises three-dimensionally between the surfaces of the two facing magazine pages when the pages are opened. This arrangement eliminates the cost of a separate 4-page cover (e.g. see U.S. Pat. No. 4,337,589) and provides a convenient and economical advertising vehicle that takes particular advantage of the present standard charges for magazine advertising which, coupled with its own significantly lower cost of production makes it particularly attractive as an advertising vehicle. By employing two facing magazine pages or just portions of two facing pages of a magazine, the charge for presence of such a pop-up structure in a widely distributed magazine is far less than the comparable charge for insertion of an interrelated 4-page cover that includes an adhesively attached dependent pop-up piece sandwiched therebetween.

Figure 3A:
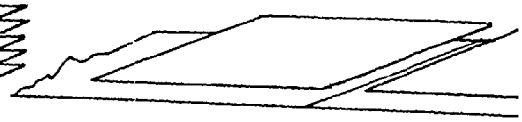
FIGS. 3A and 4A show how the pop-up pieces of FIGS. 1 and 2 might be delivered from a carrier web to magazine pages being produced.
Figure 4:
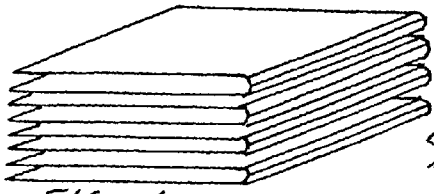
Figure 4A:
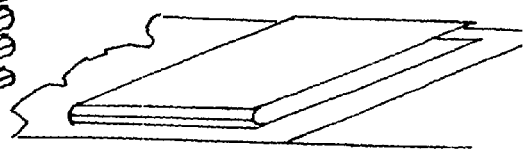
Figure 5:
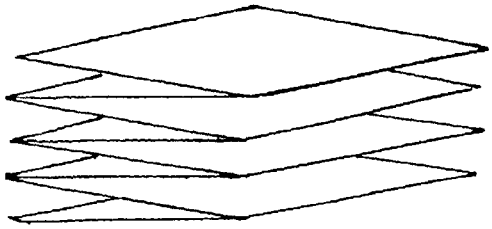
FIG. 5 demonstrates how pop-up pieces may be produced in a Z-fold from which they might be delivered to magazine pages being produced.
Figure 5A:
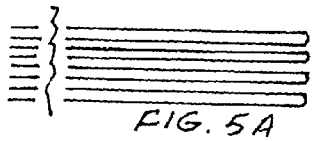
FIGS. 5A and 5B show how such a Z-fold can be trimmed so as to create a stack of either single sheet or folded pop-up pieces.
Figure 5B:
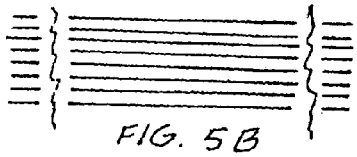
Figure 6:
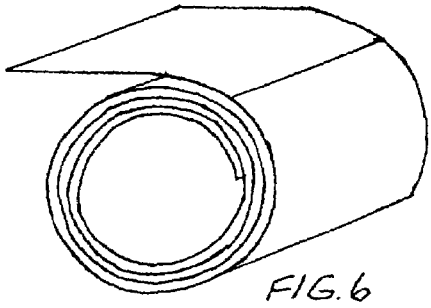
FIG. 6 shows how the pop-up pieces of FIG. 1 may be produced in the form of a roll from which they might be delivered to a magazine being produced.

FIGS. 3 and 4 show stacks of single sheet pop-up pieces and folded pop-up pieces, respectively, that could be supplied to state-of-the-art feeders for attachment to a moving web for magazine production, whereas FIG. 5 shows a group of fan-folded or Z-folded sheets. Pop-up pieces can be delivered for placement on magazine pages from any of these configurations or from a roll configuration as depicted in FIG. 6, the sheets of which would be appropriately die-cut. FIGS. 5A and 5B show how stacks, such as those shown in FIGS. 4 and 3, respectively, can be formed by severing a Z-stack along one or both edges. Alternatively, pop-up pieces, either of the single sheet variety (FIG. 3A) or the folded variety (FIG. 4A), can be delivered along a fast moving web for magazine placement. FIGS. 21 and 22 show alternative embodiments of the FIG. 1 piece wherein the pop-up piece is angularly offset from vertical alignment on the page so as to arise at an attractive angle thereto, as shown in FIGS. 21A and 22A.

Illustrated in FIG. 7A is another version of the pop-up piece illustrated in FIG. 1 where the body or flag portion of the piece is enlarged and includes a note N bearing pressure-sensitive adhesive g which is hinged to the main body along a line of weakness P which may be a line of perforations. This edge may be optionally removed after folding. The note N may be similar to a Post-It® pressure-sensitive note, and is presented to the recipient when the flat panel rises up from the plane of the magazine page, enticing the recipient to remove it and place it near a telephone, in an office, on the surface of a refrigerator, etc. using the pressure-sensitive adhesives. FIG. 7A shows the piece prior to folding, and FIG. 7B shows it as it might be fed during magazine production.

Figure 8:
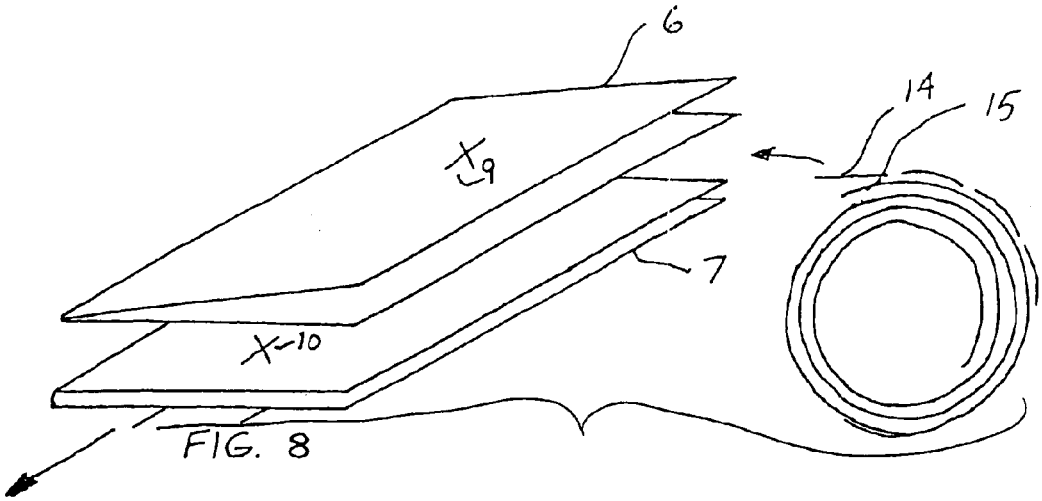
FIG. 8 is a schematic perspective view which shows how a pop-up piece might be fed from the roll of FIG. 6 and applied between adjacent signatures in a high-speed magazine production line for perfect-binding.

FIG. 8 depicts a magazine or the like being conveyed in the direction of the arrow with a signature 6 being placed on top of a signature 7, as would be the case in a glued backbone "perfect bound" magazine or the like. The regions X indicated by the reference numerals 9 and 10 represent possible locations where a pop-up piece might be placed as a part of the high speed production process. To the right of this structure is shown a rolled-up liner 15 which carries a plurality of pop-up pieces 14 (similar to the arrangement shown in FIG. 3A) which might be employed to deliver the pop-up pieces to an appropriate feeding mechanism (not shown).

Figure 9:
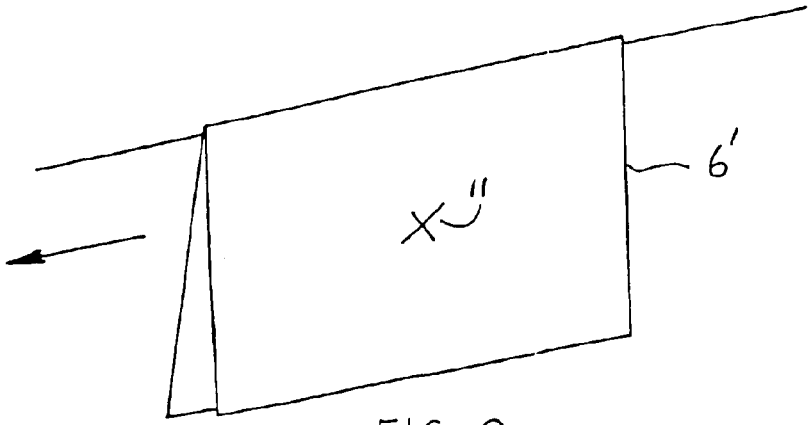
FIG. 9 is a perspective view showing the movement of a 4-page signature which will become a part of a saddle-stitched magazine which will then be covered by the next signature dropped on top thereof.

Shown in FIG. 9 is a signature 6' that is being conveyed in the "over-the-saddle" orientation or saddle-stitch binding, with X marking a region 11 as being an example of placement of a pop-up piece, that will then be joined to the next signature that will be placed "over the saddle" atop the signature 6'. A similar high speed production method is shown in further detail in FIG. 10 where the signature 6 is being conveyed at high speed on a chain C for "saddle-stitch binding" or alternatively for just collating. A pop-up piece 14" is placed on the moving signature, through the use of a feeder 18, as it is being carried therepast on the chain, and subsequently a second signature 6" will be placed upon the saddled signature 6' so that the pop-up structure becomes adhesively attached to facing pages. Shown in FIGS. 11A and 11B are alternative designs of a pop-up structure to those shown in FIGS. 1 and 2. FIG. 11B of course is a folded version of the structure shown in FIG. 11A in which folding has occurred along the vertical centerline of the piece. Many other configurations are illustrated in U.S. Pat. No. 6,068, 903, the disclosure of which is incorporated herein by reference.

Adhesive can be completely or partially applied to the pop-up piece prior to its attachment to the signature page, or the adhesive can be completely or partially applied to each page. For example, if desired, coadhesives or heat or electrostatic or high frequency-activated adhesives could be applied to both; also, more than one type of adhesive could be applied to create a pop-up structure. However, adhesive is preferably applied to the surfaces of the pop-up piece by gravure cylinder, printing plate, screen extrusion means or a combination of the like during the process of printing, die-cutting and/or feeding of the pop-up piece, so that an adhesive-bearing pop-up piece is preferably placed in contact with the moving printed magazine page. Moreover, adhesive on one or more surfaces of the pop-up piece will be free from contact with another surface because wheels, tapes, roller combinations and the like will be used to provide paths that avoid undesired adhesive contact prior to affixing. This allows accuracy in affixing of the pop-up piece to a page moving at high speed, i.e. initially to one of two sequential magazine pages, then to the other. Such attachment can be carried out while the pages are being printed and are still part of the web from a web printing press, or afterward while the signatures are being bound on a collating/binding line after printing. In either instance, attachment may easily occur without stoppage of the movement of the signatures aided by such pre-adhesive application to the pop-up pieces, which may occur even prior to the printing of the magazine pages as described hereinafter.

Very generally, adhesive is preferably applied to the pop-up piece while it is being printed or afterwards, but separately from the magazine signature pages being printed or bound. This arrangement separates the less costly operation of creating the pop-up pieces from the vastly more complex and high cost magazine printing and binding operation so that a possible malfunction with respect to providing the adhesive-carrying pieces will not potentially interrupt the high speed magazine production. Because the act of adhesive application is straightforward in this art, it is not specifically illustrated hereinafter with respect to the methods depicted in FIGS. 11, 18 and 19.

Further illustrated in FIG. 11 is a saddle-binding production arrangement wherein there is placement of a pop-up piece which shows a bit more detail. As a signature 6' is being conveyed along the chain C of a saddle-stitch binding line, a folded pop-up piece 16 is fed from a pile-type applicator 18 onto a location on an outer surface of the signature 6'. At the next pocket of the high speed collation and binding line, a second signature 6" is draped over the top so as to sandwich the pop-up piece 16 therebetween and complete the magazine pop-up structure, and in subsequent pockets, additional folded signatures 6'" are draped upon the saddle assembly. If desired, a second feeder 18 could be located in one of these downstream pockets to create a second magazine pop-up structure. Once the assembly is complete, binding by stitching or stapling along the centerline is effected to form a magazine, a brochure or the like. Opening of the appropriate pages from signature 6' 6", etc. spreads them apart and causes the pop-up piece 16, as depicted in FIG. 11C, to assume its attractive three-dimensional configuration.

Figure 12:
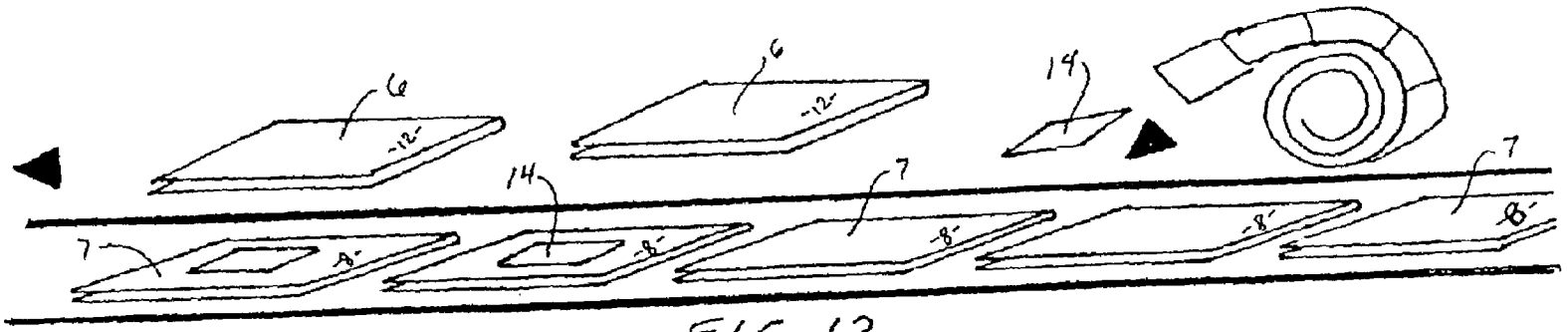
FIG. 12 is a schematic perspective view further amplifying the production method shown in FIG. 8 where a pop-up piece is severed from the end of a roll and placed atop a signature where it will be sandwiched between that signature and another applied from above to form a magazine pop-up structure.

It should be understood that for perfect binding applications, it is possible to place the pop-up pieces on a page or a selected area on the web from a web printing press, with the web thereafter being folded into a configuration which positions the pop-up piece on the top, bottom or middle of a signature that has been printed, which placement is carried out without interrupting the collation and binding of a perfect-bound magazine. One such arrangement is exemplified hereinafter in FIG. 19; however, FIG. 12 diagrammatically shows a high speed production such as that depicted in FIG. 8 where a pop-up piece 14 is being fed and applied onto a signature 7, being thereafter sandwiched between it and a second signature 6. More detail is set forth in respect of FIGS. 18 and 19.

More than one of such a pop-up piece applicator can be used if desired either to feed alternately at slower speeds or to incorporate two pop-up pieces at different locations within a magazine. An applicator may, as pointed out, be capable of feeding from rolls or stacks of individual pieces, fan-folded pieces or pieces carried back to back or on a liner. Such feeding equipment can be equipped with self-contained or auxiliary adhesive applicators, and these applicators may be modular to permit relocation up and down a line of conveyor travel. These units may be mechanically or electronically synchronized to duplicate the cycling speed of the conveying equipment. When the pop-up piece bears self-contained (previously applied) adhesive, pathways are provided for the exposed adhesive to travel without contact. For example, if rollers drive the pop-up piece through the unit, then areas on the rollers will have channels to avoid contact with the adhesive yet still drive and convey the piece. Tables within a unit may also provide non-contact paths for the adhesive. Belts and conveying tapes can also be used, and such are adjustable to convey a piece without contact with the adhesive. For particularly high speed dispensing, applicators which feed the pop-up pieces in a direction parallel to the travel direction are preferred; however, feeding at an angle, even a right angle, to the direction that the conveying line travels may be acceptable in many instances.

Shown in FIGS. 13 through 13C is another type of pressure-sensitive adhesive configuration which might be used to create pop-up structures. As best seen in FIGS. 13A and 13B, staggered adhesive patterns on the outer surfaces of one of the panels would be located along what would be the foot or base end of the pop-up piece, and similar staggered adhesive patterns would be located along the head end of the inside surfaces of the Z-folded arrangement. The printed, adhesive-carrying strip would then be folded as depicted in FIG. 13, and both edges would be trimmed, as shown in FIG. 5B. When the piece is then attached between facing pages of signatures in a magazine, and those pages are opened, as depicted in FIG. 13C, the pop-up piece would assume a tent-like configuration. Again, by having a line of perforations P serve as a line of weakness along the foot or base panels, the recipient, if so desiring, could split the pop-up structure at the head, as described before, and then remove one flag panel from its attachment to the base or foot, which may remain secured to the page of the signature, by tearing along the line of perforations. The recipient would then have a reminder note that could be placed against a flat surface using the pressure-sensitive adhesive that is carried by the interior surface.

Figure 14A:
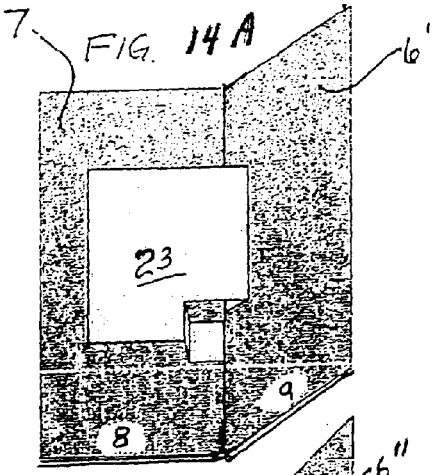
FIG. 14A is a perspective view showing that pop-up piece mounted in a magazine between pages 8 and 9 with the pages spread open.
Figure 14:
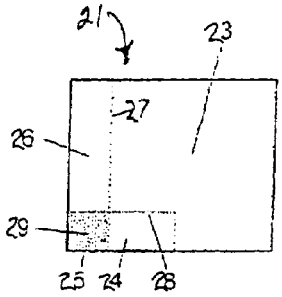
FIG. 14 is a front view of a pop-up piece of the type shown in FIG. 1.

FIG. 14 shows a slightly more detailed version of a single sheet pop-up piece similar to that shown in FIG. 1. A piece 21 is depicted as having a main flag or graphic area 23 which has a single leg 24 created by severing the sheet material by die-cutting or the like, along a line 28. Although the line 28 is shown as being straight, it should be understood that the line of severance could have any desired shape, and the leg 24 can vary in length and shape while continuing to function as intended. The leg 24 is hinged at one end to the flag section 23 and contains a foot 25 at its free end that is preferably hinged along a line of weakness to the leg. The portion of the remainder of the piece that corresponds to the foot 25 is formed as a base panel 26 which is connected in hinged relationship to the flag panel 23 along a line of weakness 27 which is preferably a line of perforations to permit detachment if desired. The undersurface of the base panel 26 carries adhesive, and adhesive is similarly carried by the upper surface 29 of the foot, as indicated by speckling in FIG. 14.

If the pop-up piece 21 were to be included in a magazine utilizing saddle-stitch binding, it might be fed from a feeder 18 located along the path of travel of a signature 6', and it would preferably be coated on one or both surfaces with adhesive in the regions where there will be attachment of the pop-up piece 21 to the pages of the facing signature. For example, a magazine could instead be assembled using a perfect bound type of binding as illustrated schematically in FIG. 12. The pop-up piece 21 would take the place of the piece 14 and would be attached at a location near the fold-line of the signature 7 that is traveling along the straight line path illustrated therein. It would be placed at a desired location, for example on page 8, and it would be attached by the adhesive 29 on the foot panel 25. Next, as illustrated in FIG. 12, another signature 6, which would carry pages 9, 10, 11 and 12 of the magazine, might be placed atop the signature 7 as it is moving along the path so as to sandwich the pop-up piece 21 therebetween. In the illustrated embodiment, the then upper surface of the pop-up piece would be secured through adhesive on the base panel 26 to the undersurface of the signature 6 which would constitute page 9, which is of course consecutive with page 8. The adhesive used to effect the attachment is preferably coated on the panel 26 of the piece 21 prior to its being placed; however, it may alternatively be coated with adhesive after it is in place on the signature 7, or adhesive may be applied to the section of the signature 6 that constitutes page 9 prior to its association with the signature 7, with the latter two options being less desirable.

When the magazine is ultimately opened so that pages 8 and 9 are spread apart as illustrated in FIG. 14A, the pop-up piece 21 assumes an attention-attracting three-dimensional configuration with any message carried by the flag panel 23 being prominently displayed to the reader. In an instance where it would be desired to provide the reader with a coupon, the lines hinging the base panel 26 and the leg 24 to the remainder of the flag panel could be provided in the form of perforations so the coupon could be readily detached.

Figure 15A:
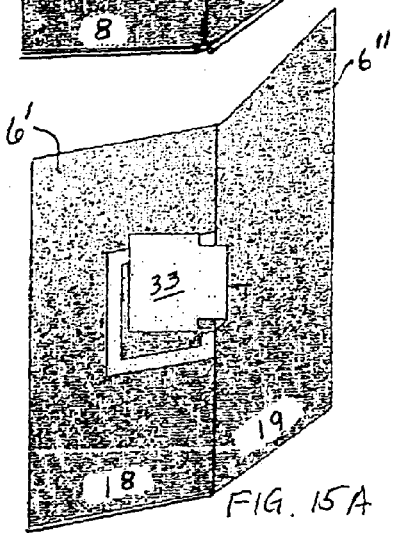
FIG. 15A is a view similar to 14A showing the FIG. 15 piece mounted between pages 18 and 19 of a magazine which are spread open.
Figure 15:
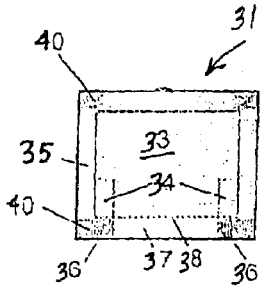
FIG. 15 is a front view of a alternative embodiment of a pop-up piece of the general type shown in FIG. 1.

Illustrated in FIG. 15 is another form of a single sheet pop-up piece 31. The piece 31 bears some resemblance to that shown in FIGS. 34 through 38 of U.S. Pat. No. 6,044,490. Very generally, it includes a central flag panel 33 having a pair of hinged legs 34 and surrounded by a die-cut frame 35 which is designed to be secured to one facing page while a base panel 37, that is hinged to the flag panel 33 along a line of weakness 38, is secured to the facing page of the magazine. The frame 35 terminates in what constitute foot panels 36 at the end of each of the legs 34. It is considered sufficient to secure the frame 35 through patterns of adhesive 40 provided at the four corners on one surface of the piece, with adhesive on the opposite surface being used to attach the base panel 37 to the facing page.

Figure 10:
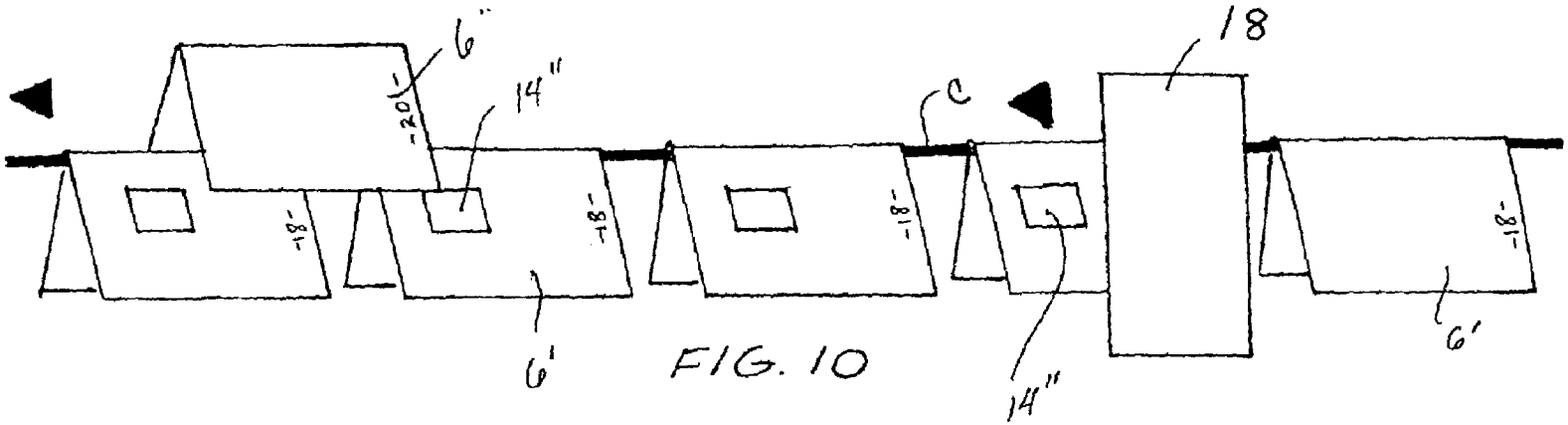
FIG. 10 is a schematic view further exemplifying the method depicted in FIG. 9 where the application of the pop-up piece is to an outer surface of a signature destined for a saddle-stitch magazine.
Figures 11, 11A, 11B, 11C:
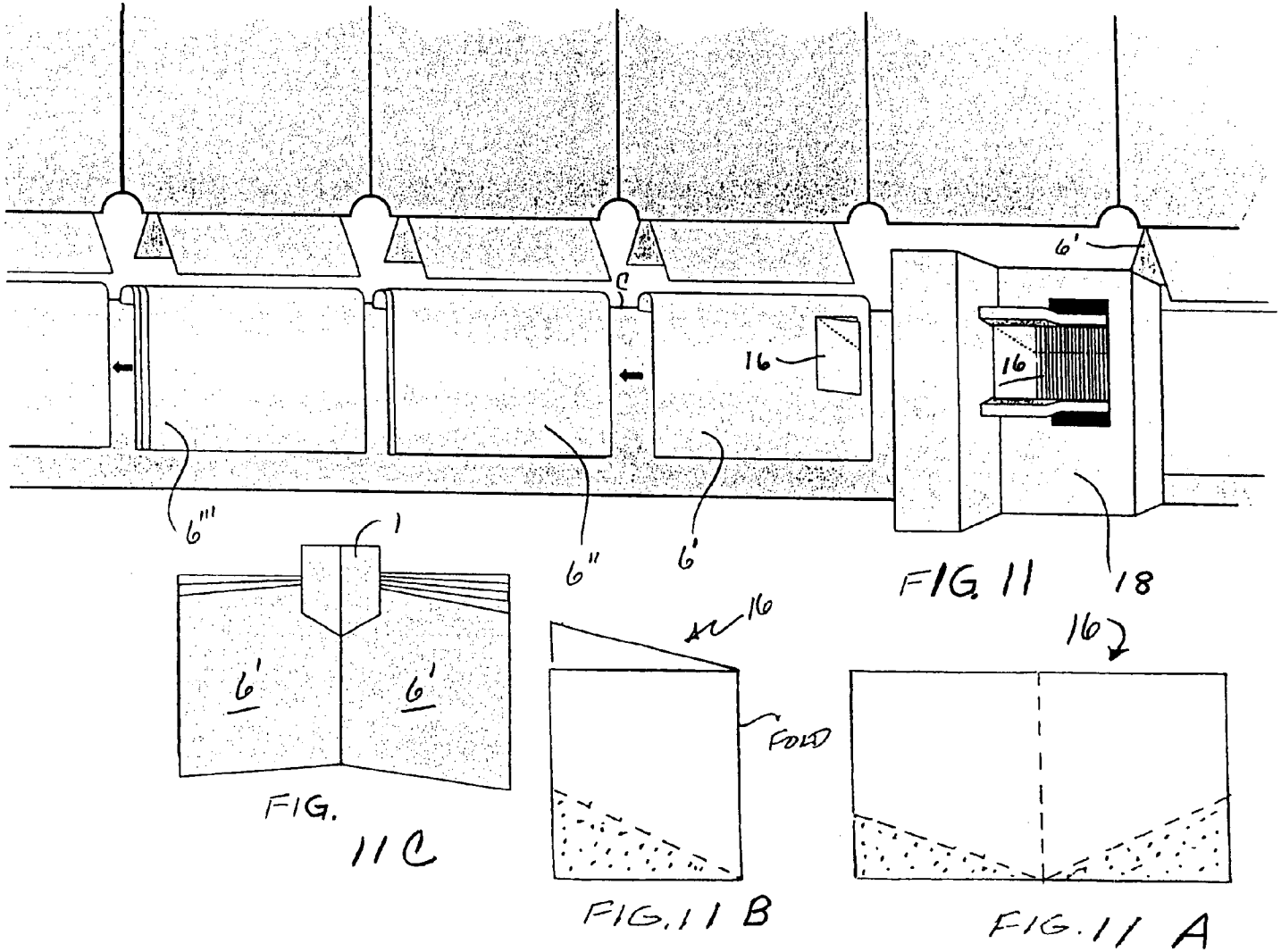
FIG. 11 is a diagrammatic perspective view showing the application of a pop-up piece to an outer surface of a signature that is being employed in the production of a saddle-bound magazine.
FIGS. 11A and 11B show more detail of the pop-up piece shown in FIG. 11 that might also be employed in other production-line methods.
FIG. 11C is a perspective view showing the magazine incorporating the completed pop-up structure open to the pages to which the pop-up piece of FIG. 11B was attached.

For example, in a saddle-stitch binding type operation such as illustrated in FIG. 10, signatures with page 18 for example being one of the outer pages may be conveyed along a path on a chain C where they will pass a feeder 18 from which the pop-up piece 31 can be applied adjacent the centerline of the signature rather than the piece 14" illustrated in FIG. 10. An additional signature 6" is then positioned atop the moving signature 6' with the signature 6" including pages 19 and 20 on the right-hand side thereof. As earlier indicated, the frame 35 might be secured at its corners to page 18 of the signature 6' via adhesive that was applied previously to the pop-up piece 31 or less desirably previously applied to page 18. As indicated previously with respect to the piece 21, the base 37 becomes adhesively attached to page 19 of the signature 6" when this signature is placed in position thereatop.

When the magazine is opened as depicted in FIG. 15A so that pages 18 and 19 are spread apart, the flag panel 33 is moved out of the plane of the frame 35, being pulled by attachment of the base panel 37 to the page 19 and being supported at top and bottom by the legs 34, so as to assume an attention-attracting three-dimensional configuration. Again, should it be desired to provide a coupon as part of the pop-up piece 31, the hinge line 38 and the two short hinge lines between the legs 34 and flag panel 33 can be provided in the form of perforations, or alternatively a line of perforations can be run all the way across the panel 33 co-linear with the short hinge lines which link the legs 34 thereto.

Figure 16A:
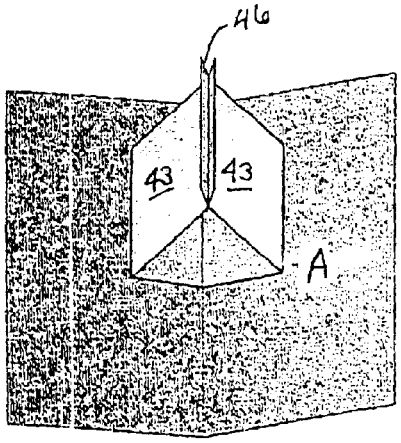
FIG. 16A is a perspective view generally similar to FIGS. 14A and 15A showing the pages of the magazine spread open with the pop-up piece of FIG. 16 in three-dimensional configuration.
Figure 16:
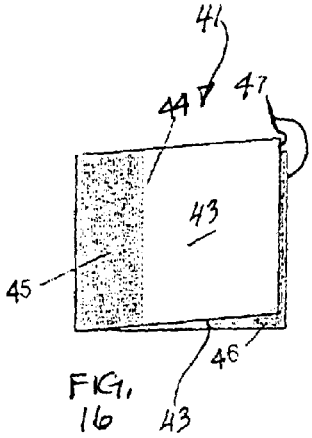
FIG. 16 is a perspective view showing a pop-up piece of the general type shown in FIG. 2.

Illustrated in FIG. 16 is a folded pop-up piece 41 which includes a pair of flag or graphic panels 43 which panels are connected along hinge lines of weakness, preferably perforations 44, to base panels 45. The base panels are hinged together at the fold line of the piece, and the opposite edges of the piece are releasably interconnected by a vertical strip of pressure-sensitive adhesive 46 which preferably extends along the entire free edge 47 of both panels and which adheres substantially equally to both. The piece might, for example, be applied to the magazine pages while they are being printed and assembled as part of a web fed press as illustrated in FIG. 18. Although a wide variety of variations are possible, the folded pop-up piece 41 would be deposited in the desired strategic position on an appropriately printed page near a line where the final magazine will be folded. Its attachment is preferably the result of adhesive that was pre-applied or is being applied as a part of a feeding mechanism 18*a* to the undersurface of the pop-up piece 41 being placed thereon. In the arrangement illustrated in FIG. 18, two interconnected pages A and B are referred to generally as a signature, and eventually, as a part of the magazine production, the signature comprising pages A and B would be covered by another signature so as to sandwich the folded pop-up piece 41 therebetween. Such a covering signature could be the signature comprising pages C and D, which might be either folded over while still a part of the web so as to cover the panel A-B signature (in which case the pop-up piece would be sandwiched between pages A and D with the upper surface of the pop-up piece 41 becoming adhesively affixed to the page D). Alternatively, the web shown in FIG. 18 could be slit longitudinally, and the section of the web including pages C and D displaced to simply reside atop the other half of the web, in which case the pop-up piece 41 on page A would become adhesively attached to the page on the undersurface of page C. As a further alternative, other signature-containing endless strips of printed web material could be slit from a still wider web or from a totally different web, and shifted to be positioned atop the signatures containing pages A and B. In any respect, the page that is consecutively numbered to the page number of sheet A would end up in facing juxtaposition therewith.

Figure 16B:
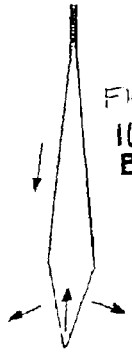
FIG. 16B is a side schematic view of the pop-up piece of FIG. 16 showing its construction and depicting its movement when the facing pages of the magazine are opened and spread apart.

Once the magazine assembly has been completed, opening it so that page A is spread apart from the facing page, as depicted in FIG. 16A, causes the pop-up piece to rise in attention-attracting three-dimensional tent-like configuration (schematically moving as shown in FIG. 16B), held together at its upper edge by the strips of adhesive 46. The arrangement is shown with these edges spaced apart slightly for purposes of illustration, although it should be realized that they would be in surface-to-surface contact in the magazine as delivered to the recipient. However, by employing pressure-sensitive adhesive 46, the pop-up 41 could be easily split by the recipient into two separate panels, with each of the panels 43 bearing either a similar or a totally different message. These message-bearing panels could then be detached from the magazine pages by simply tearing along the perforations 44, and the recipients would have a pair of notes or the like that could be placed on a suitable substrate and held in place through the line of pressure-sensitive adhesive 46 in much the same manner as the very familiar, widely distributed Post-It® brand notes.

Illustrated in FIG. 17 is yet another pop-up piece 51 that bears some resemblance to both the piece illustrated in FIGS. 11A and 11B and the concept described with regard to the piece 41. The piece 51 is made from a pair of rectangular sheets 52, although the shape of these could of course be varied if desired. Each sheet is formed with a main flag or graphic panel 53 and a triangular base panel 54 that is hinged to the panel 53 by a line of weakness 55 in the form of a line of perforations. The two sheets 52 are juxtaposed and are held along one edge by a strip of pressure-sensitive adhesive 58 that causes the interior surfaces to adhere to each other (as just described with respect to the adhesive 46). The exterior surface of each of the triangular panels 54 is covered with adhesive of stronger bonding strength that will cause these two triangular panels to more strongly adhere to the surfaces of two facing pages of a magazine at a location along the spine of the magazine. The pop-up piece 51 is preferably made with the strip of adhesive 58 adhering the two sheets to each other, and it can be assembled into the magazine using any one of the three manners previously described with regard to the pop-up pieces shown in FIGS. 14, 15 and 16.

When the facing pages are then opened as illustrated in FIG. 17A, the pop-up piece 51 assumes the attention-attracting three-dimensional configuration shown. As previously mentioned, both of the flag or graphic panels 53 can carry a similar message or they can carry different messages. They can be detached along the lines of perforation 55 and split apart into two separate notices which can be adhered by the recipient to a substrate in an appropriate location for use as a reminder, message or the like.

FIG. 18, to which reference was earlier made, shows a web fed press that is printing sheet material that has four panels abreast, labeled A, B, C and D. A folded pop-up piece 61 similar to that shown in FIG. 2 is placed upon the moving panel A at Station No. 1 by feeding mechanism 18*a*, and a single sheet pop-up piece 62 is simultaneously placed upon the panel C by a feeding mechanism 18*b*. By suitable manipulation of the web, the web fed press can be employed to produce a signature composite which may then be severed from the end of the web, one or two composites at a time, and they can be incorporated into a perfect-bound magazine or a saddle-stitched magazine. Alternatively, this type of arrangement may be used to produce a folded magazine similar to the well known Sunday supplement Parade magazine. Such might be accomplished, for example, simply by associating three other signatures with the A-B signature and the C-D signature that are depicted, one atop another to provide, when folded along the centerline, a 20-page magazine. By coating both base panels 65 of the piece 61 with adhesive prior to or at the time of feeding, the piece will become securely attached to both facing pages when the assembly is complete and/or when folding along the centerline is accomplished. Likewise, similar application of adhesive to the appropriate panels of the single sheet piece 62 will allow it to likewise form a pop-up structure in combination with the facing pages.

Applicators on a high speed web press generally operate at a higher speed than those on binding line type of conveyance; yet, they can still be equipped with adhesive applicators or can handle a pop-up piece that has self-contained adhesive. Applying the pop-up pieces on a high speed web press may offer more versatility of placement, and modular applicators can be positioned to apply a piece before folding a signature or after folding a signature. Application of pieces upon a web press effects sizable cost reduction and more options of placement.

Figures 19, 20:
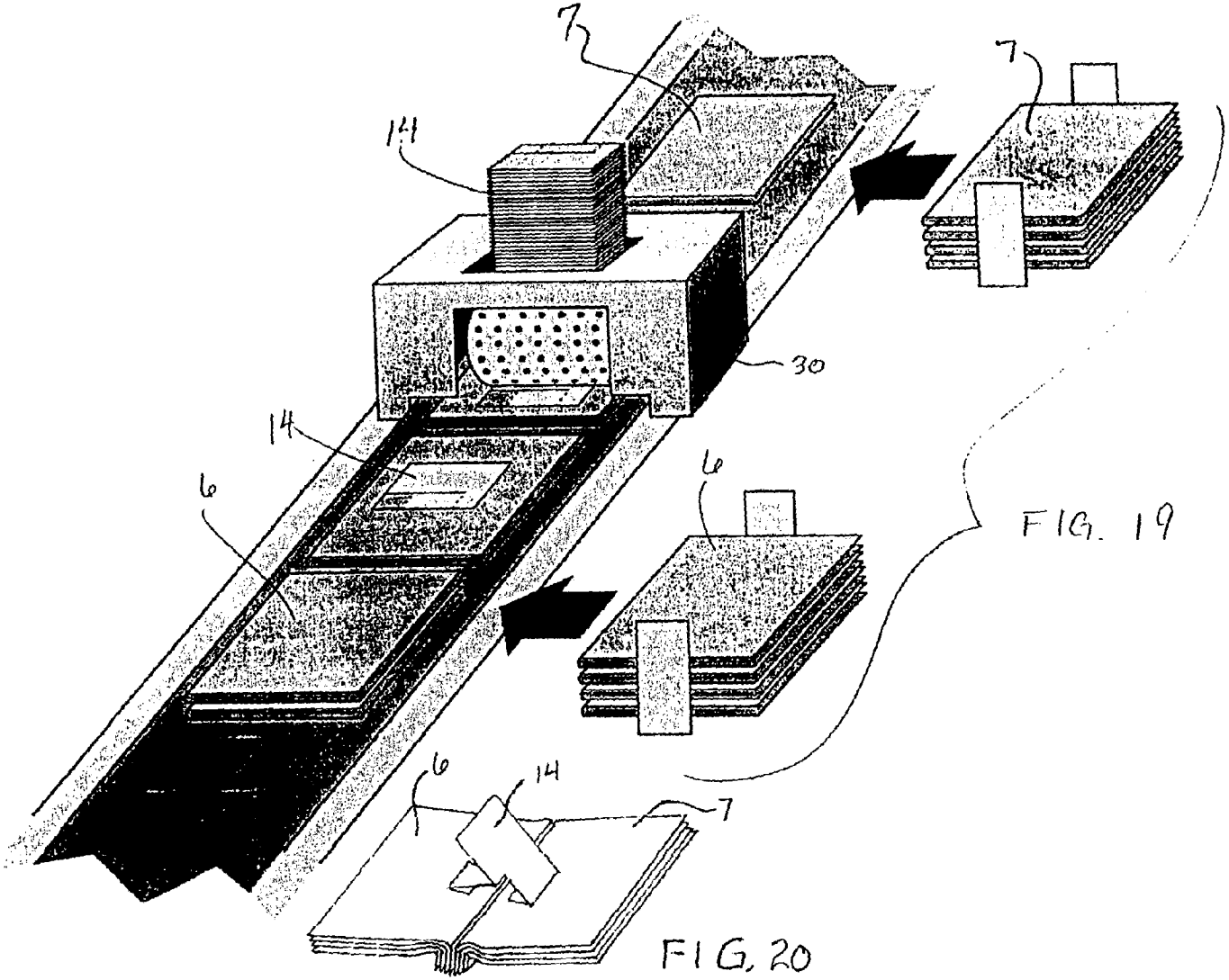
FIG. 19 is a diagrammatic perspective view showing the application of a pop-up piece from a stack onto a signature in a perfect-bound magazine production line.
FIG. 20 is a perspective view showing the magazine which results from the FIG. 19 production method in open configuration with the pop-up piece extended in three-dimensional configuration.

Diagrammatically depicted in FIG. 19 is a more detailed feed arrangement for a high speed production method similar to that depicted schematically in FIG. 12. More specifically, signatures 7 that have been folded in half are shown as being fed onto and conveyed along a high speed line past a vacuum roll-feeder 30 which removes a pop-up piece 14 from the bottom of a stack 16 and places it on the top (outside) surface of the moving folded signature 7. At a later station, the signature 7 would be covered with a folded signature 6 to which the opposite surface of the piece will become adhesively attached, and in turn additional signatures (not shown) would be placed thereatop as a part of the collation process preliminary to the final perfect binding. The resultant perfect bound magazine or pamphlet is shown in FIG. 20 where it has been opened so that the adjacent pages from signatures 6 and 7 are spread apart, causing the adhesively attached pop-up piece 14 to assume the attractive three-dimensional configuration. If desired, the line could have multiple feeders located in sequence where one could feed the pop-up piece 14 and the next one downstream could feed an item, such as a coupon, note or stamp onto the pop-up piece; for example, a variety of game pieces could be fed wherein there would be only a few winners of sorts and mostly nonqualifiers.

The foregoing methods can employ known machinery used in this art and referred to as tippers, label applicators and card feeders, as well as custom-design units, to accomplish the feeding steps. Such mechanisms are capable of operating with stream, stack or pile, or roll feeding, and they can be provided with shingle, top-feed and bottom-feed capabilities. Such suppliers of feeding applicators of this type include GA Vehren, Label-Aire, Longford, Muller Martini, Quadrel and Streamfeeder. It will of course be understood by those skilled in this art that various of the methods illustrated and described hereinbefore can be combined with one another to create a desired product in a particular production method.

Illustrated in FIG. 21 is a single sheet pop-up piece that is designed with angular lines of weakness which would be placed on a signature, as shown in FIG. 21A, at an angle to the edge of the page so that it would open in an askew fashion. FIG. 22 shows a single sheet pop-up piece that achieves a generally similar configuration although it can be placed in parallel alignment with the edge of the pages of the signature (FIG. 22A) by arranging the line of weakness that defines the affixation panel so that this line will be at an angle of about 30° to the spine of the signature.

Figure 25:
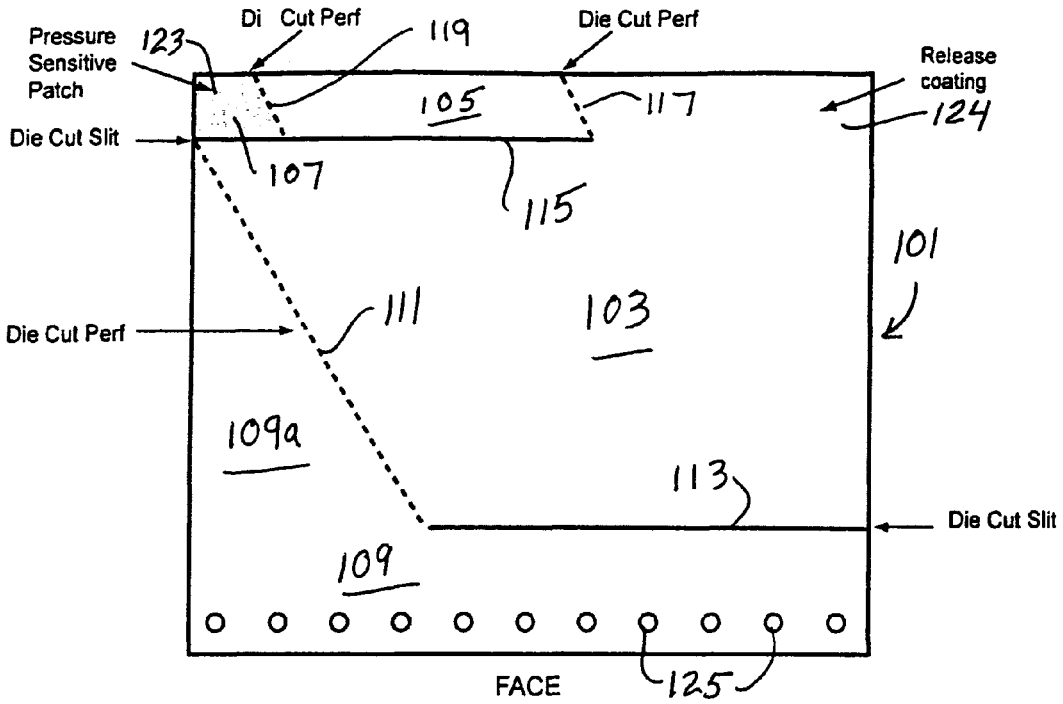
FIG. 25 shows the "face" side or surface of a single sheet pop-up piece similar to that shown in FIG. 21 that is designed to be fed for attachment to signatures being printed on a high-speed rotogravure printing press or other such high speed web press.

Illustrated in FIGS. 25 to 40 is a single flat pop-up piece of sheet material (preferably paper) that has design versatility to enable its feeding in a format in which it can be affixed, at very high speeds, during the printing of magazines and the like; a preferred method for making such magazines is also shown. FIG. 25 shows the upper surface or "face" of a single pop-up piece 101 which is die-cut so as to have a primary graphic area or flag panel 103 having an attached leg 105 that is formed with a hinged foot 107. The remainder of the piece is referred to a base portion 109, it assists in both the feeding of the piece and its affixation to the desired page of a magazine or the like. The base portion can optionally also contain graphics. In the illustrated embodiment, the base 109 includes a triangular region or section 109*a* that is hinged to the flag panel 103 and flexible paper and the angular orientation allows the desired display of the graphic-carrying flag panel when the magazine is opened.

Figure 26:
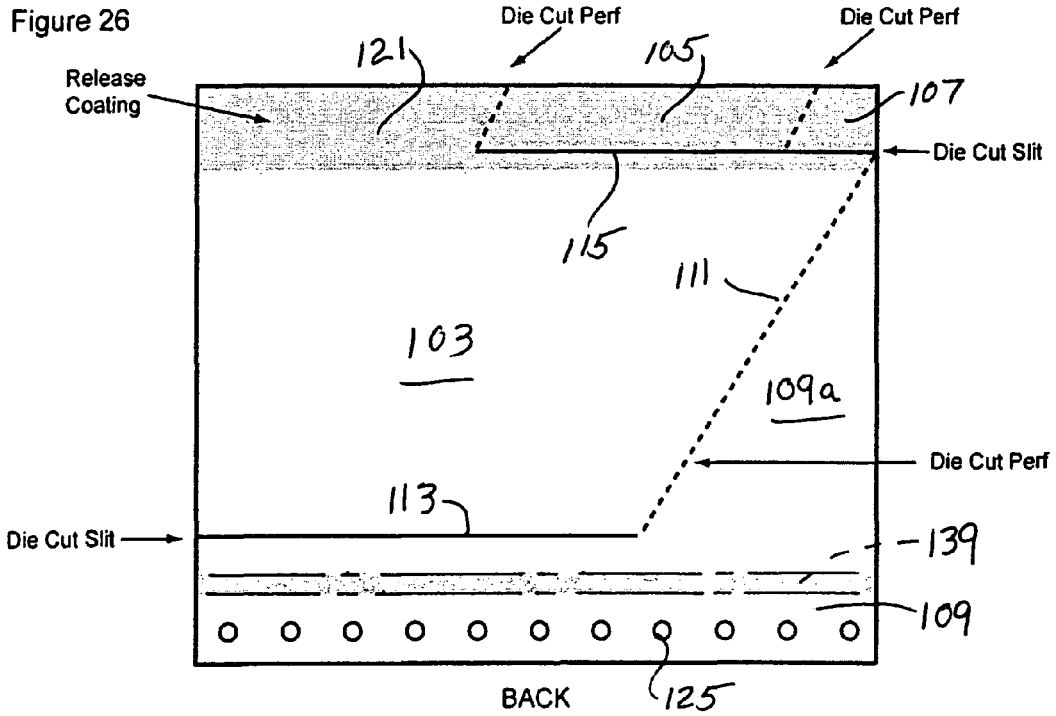
FIG. 26 shows the opposite side or rear surface of the pop-up piece in FIG. 25.

FIG. 26 shows the piece 110 from the opposite or rear surface; however, depending on the orientation desired for the ultimate pop-up, the surface shown in FIG. 26 could alternatively be considered to be the front or face surface.

It should be understood that there are a number of key elements that play a part in the handling and the speed of movement for which a properly designed single sheet pop-up piece is required to incorporate; these include the following items: the weight of the sheet material, e.g. paper, the direction of the grain of the paper, the extent of the die-cutting to which the paper has been subjected, the positions of the individual die-cuts, the amount and type of adhesive to be applied, the positioning of the adhesive, and the overall compatibility of the adhesive positions with the capability of the feeding equipment that will be used to place the pop-up item as part of a mass production fabrication of magazines. The pop-up piece 101 illustrated in FIG. 25 is designed to be preferably fed in a direction from right to left so that, in its approach to the page of the magazine to which affixation will take place, the triangular section 109*a* of the base section is at the leading or head end of the piece. The strength of the paper is selected so that the strip of pieces arranged in end-to-end is capable of being pulled. The die-cutting to which the paper web is first subjected creates a line of perforations at 111 and a slit 113 that define the relative areas of flag section 103 and the base section 109. It also creates a second slit 115 that defines the leg, which slit is preferably parallel to the slit 113. A short line of perforations at the end of the slit 115 provides a hinge line that connects the leg to the flag panel 103, and a second line of perforations 119, preferably parallel to the line 117, defines the short foot 107 at the end of the leg. A pattern of pressure-sensitive adhesive 123 is applied to the front surface as to preferably cover the entire region of the foot 107, as shown in FIG. 25.

Figure 23:
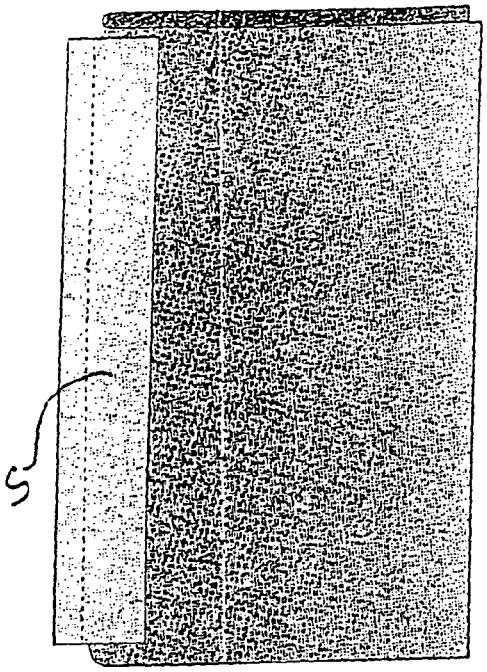
FIGS. 23 and 24 show prior art concepts used to incorporate a 4-page cover bearing a pop-up piece into a magazine.
Figure 24:
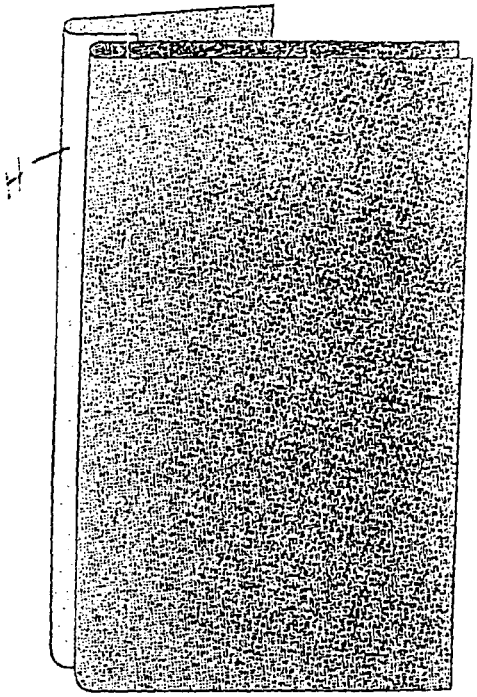

To facilitate a commercially feasible high speed fabrication method, for example, the placement of over 50,000 and preferably about 100,000 pieces per hour, the illustrated rectangular design of the pop-up piece 101 is considered to be important. It of course also facilitates the prefabrication of the pop-up pieces in a fan-folded arrangement as depicted in FIGS. 27 and 28, which is the preferred configuration. It has been found that this design not only allows significant versatility in design, but it also provides adequate tensile strength when the die-cuts are aligned with the grain of the paper, that facilitates use in this method that is illustrated herein. This is in contrast to prior art methods where such qualities were inherently lacking, and as a result, a pop-up piece required a front and back cover for support in order to facilitate handling at the extremely high rates of speed that are characteristic of economical production from a printed web, for example, as a part of a web press operation wherein the web is sliced into a plurality of ribbons, such as illustrated hereinafter. The solution to this problem that was employed utilized the addition of a binding strip or hanger as shown in FIGS. 23 and 24.

Storage of preprinted strips 126*a* (FIG. 30) in roll form, prior to creating the preferred fan-folded arrangement desired to facilitate affixation upon the magazine page at high speed, which strips carry the pressure-adhesive patterns 123 on their upper surfaces in the region of the foot 107 (see shaded region 123), is made feasible by applying a continuous strip of release coating 121 along the longitudinal edge of the rear surface or undersurface of the strip of paper, i.e. in the region that includes the leg and foot 105, 107 (FIG. 26). To facilitate the later, final perforation and fan-folding of this elongated strip of pop-up pieces 101 to precondition it and store it in a container 127 (as shown in FIG. 27) designed for subsequent high-speed feeding, a region 124 of release coating, slightly larger than the adhesive pattern 123 is applied to be the upper surface of the strip along the edge where the leg 105 is located, positioned at the tail end of each piece 101. Although a longitudinal line of pinholes 125 is provided along the opposite edge of the elongated strip of interconnected individual pop-up pieces to facilitate feeding using some feeders as are well known in this art, they are only optional; other feeders, such as the commercially available Hurletron ElectroCard feeder, can simply frictionally grip the edge of the strip without the need to employ auxiliary pinholes.

The elongated container 127 constitutes a well known box-style arrangement for storing and feeding long strips of fan-folded individual units. However, because the labels are more economically stored in roll form, the production of the pop-up pieces is generally carried out as a part of a two-step method. First, the pop-up pieces are initially printed on long webs or strips which are die-cut and perforated with the angled perforations, as shown in FIG. 30 and with the patterns of pressure-sensitive adhesive 123 and the release material 121, 124 applied; however at this point, transverse lines of perforation that will divide the adjacent pieces are not added. These printed strips carrying the pressure-sensitive adhesive and the release material are then wound into large rolls for storage until ready for use. Thereafter, the continuous strips 126*a* from the rolls are fed through a folder/perforator which adds transverse lines of perforations 131 seen in FIG. 29 and folds the strip in zig-zag fashion, as best seen from FIGS. 27 and 28. The zig-zag folded strip 126*b* is automatically filled into the elongated containers 127, from which the strips of pop-up pieces are withdrawn, as depicted in FIG. 28, and fed at high speed to the application mechanism.

A state-of-the-art automatic splicer is used to join the fan-folded strips from individual containers to produce a continuous stream. Because of the novel design of the pop-up piece, as can be seen from FIGS. 29 and 30, die-cutting preferably never reaches the side edges of the strip and the tensile strength is essentially constant across the entire width. The two die-cuts 113 and 115 that define the portion of the base and the leg both terminate within the confines of the strip itself, and as mentioned before, they are parallel to each other. Of course, once the individual pop-up piece 101 has been separated from the next adjacent pieces, these cuts are at the head and tail edges, respectively, but at this time, the high speed conveying operation is over and the pop-up piece 101 is just about to be fixed to the page of the magazine. Thus, this unique design preserves the tensile strength of the paper web across the entire width of the strip and allows this high speed mass production fabrication on a web press or the like that makes the invention so economically attractive.

Figure 31:
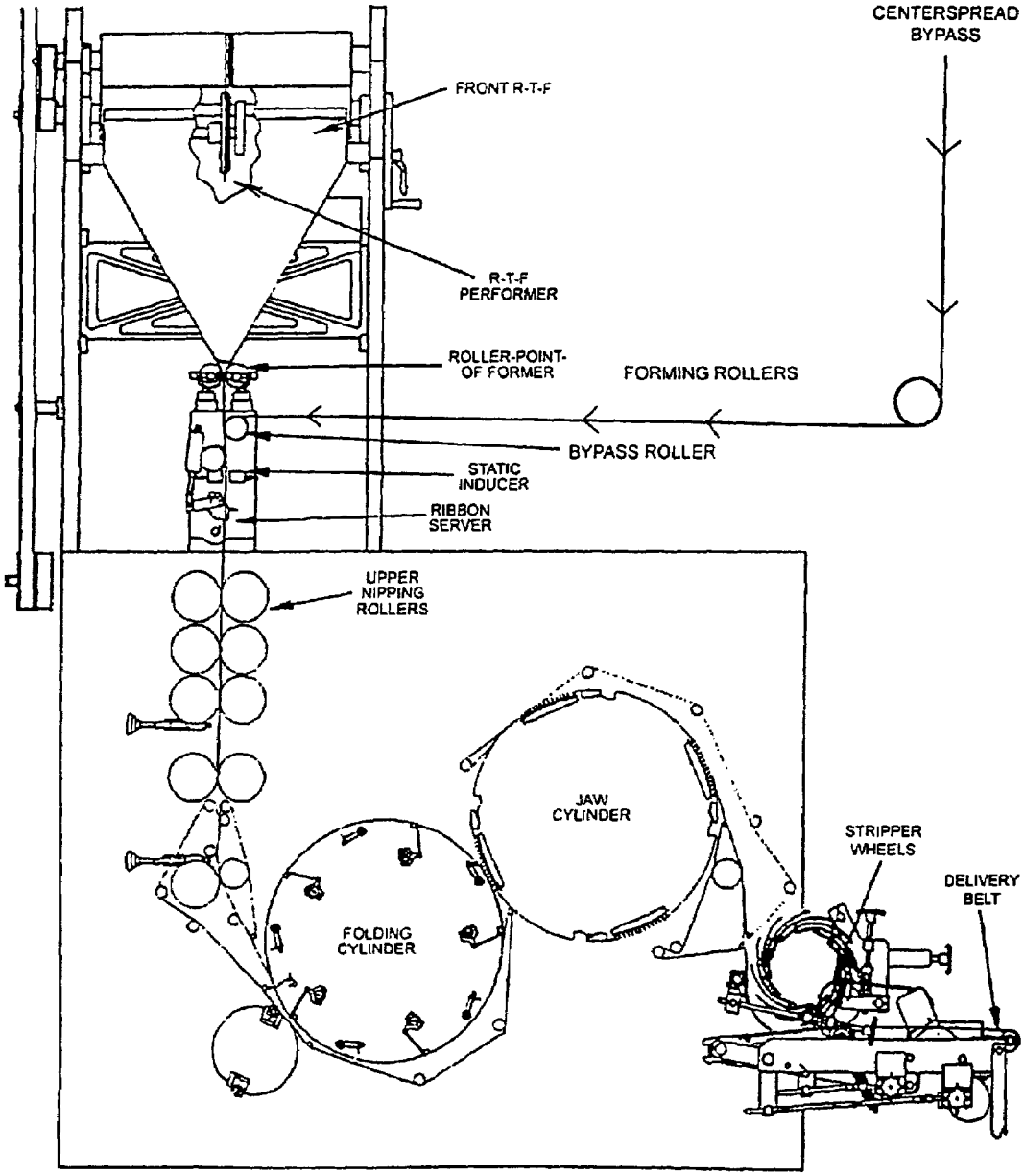
FIG. 31 is a schematic view of a layout of an inline finishing line integrated as part of a high speed web press that prints magazines, showing an arrangement that may be used to affix single sheet pop-up pieces of the type shown in FIG. 28.
Figure 32:
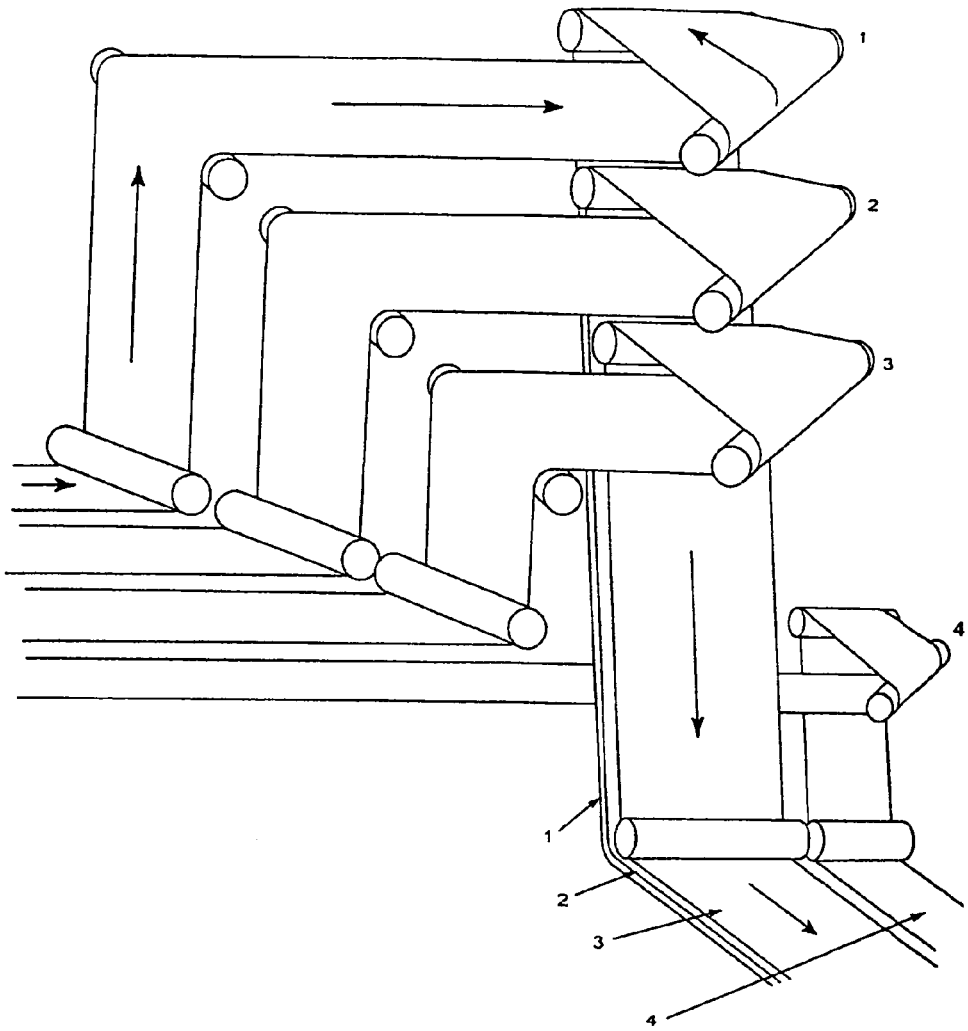
FIG. 32 is a schematic view showing printed web ribbons after leaving the printing area of a press, following travel through the print cylinders and drying units, as they enter the turn bay/angle bar section that is inline with the press.

Depicted in FIG. 31 are the components of a finishing line which is typical of that used with a high speed, inline web press, particularly a press of the rotogravure type. The press might be run at a speed of about up to 46 ft/sec in a typical high speed production run and require the affixation of up to about 100,000 pop-up pieces an hour to produce a magazine such as the Parade magazine in Sunday newspapers across the United States. The web might be slit into four separate ribbons, although this is simply a matter of choice as to the total number used. Depicted in FIG. 32 is a schematic that shows these printed ribbons leaving the printing area of a press and entering a turn bay/angle bar section, that is located inline with the press, which section it would reach after exiting the printing cylinders and traveling through the drying units as well known in this art. One ribbon, referred to as the fourth ribbon, is separated from the three. This ribbon is shown as having only one-half the width of the other three ribbons, and it is this ribbon that will eventually constitute the center pages of the magazine. It is referred to as a "centerspread," and this ribbon bypasses, combining with the three ribbons at a later point as described hereinafter.

Figure 31A:
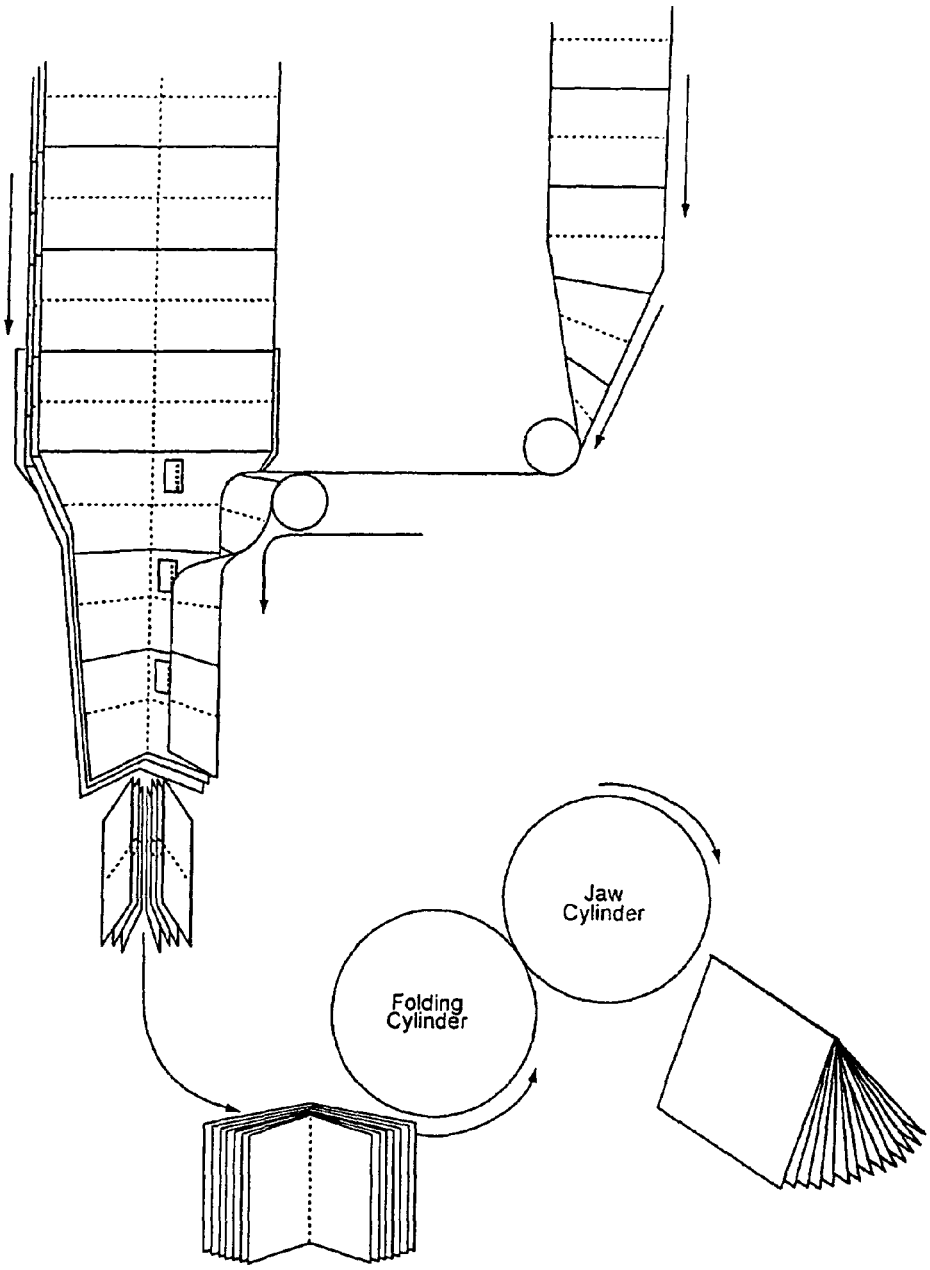
FIG. 31A is a schematic view that presents an overview of the final portion of the fabrication process showing a centerspread ribbon being juxtaposed with the half of the ribbon to which the pop-up piece has just been affixed in the R-T-F Performer and the ultimate handling and folding steps.

For high speed production, each of the three ribbons is double-paginated, i.e. instead of having two pages on each of its upper and lower surfaces, it has sets of four pages; thus each of these 3 ribbons will provide 8 numbered pages in the ultimate magazine. The three ribbon assembly that is formed in FIG. 32 is delivered to the input section of a device referred to as an R-T-F performer in which it is drawn down over a generally pyramidal guide while it is being folded in half along its longitudinal centerline, as best seen in FIG. 31A. It is at this point, where the folding is beginning or is about to begin, that the pop-up pieces are affixed to the upper surface of the rapidly moving assemblage of ribbons by a high speed placer 135 described hereinafter and shown schematically in FIG. 33. At the same time, a center perforater cuts a line of perforations through all three webs in order to separate one set of 6 pages from the other. Immediately thereafter, the centerspread, which has bypassed this section, meets the three-ply assemblage (that has now become a 6-ply assemblage) and is placed in surface contact with the 2-page section to which the pop-up piece 101 has been affixed, i.e., to a page of the uppermost ribbon of the three-ply assemblage, by gluing the base 109*a* panel thereto. As a result of the juxtaposition of the centerspread, the pressure-sensitive adhesive 123 on the foot affixes it to the facing page of the magazine's centerspread.

The fast-moving assemblage then passes through a set of upper nipping rollers (FIG. 37) which convey the now 7-ply ribbon assemblage to the standard arrangement of a folding cylinder where the assemblage is cut into individual magazine units by a rotating cutter and final folding cylinder. The final product is stripped, as by a stripper wheel assembly and fed onto a delivery belt.

Figure 29:
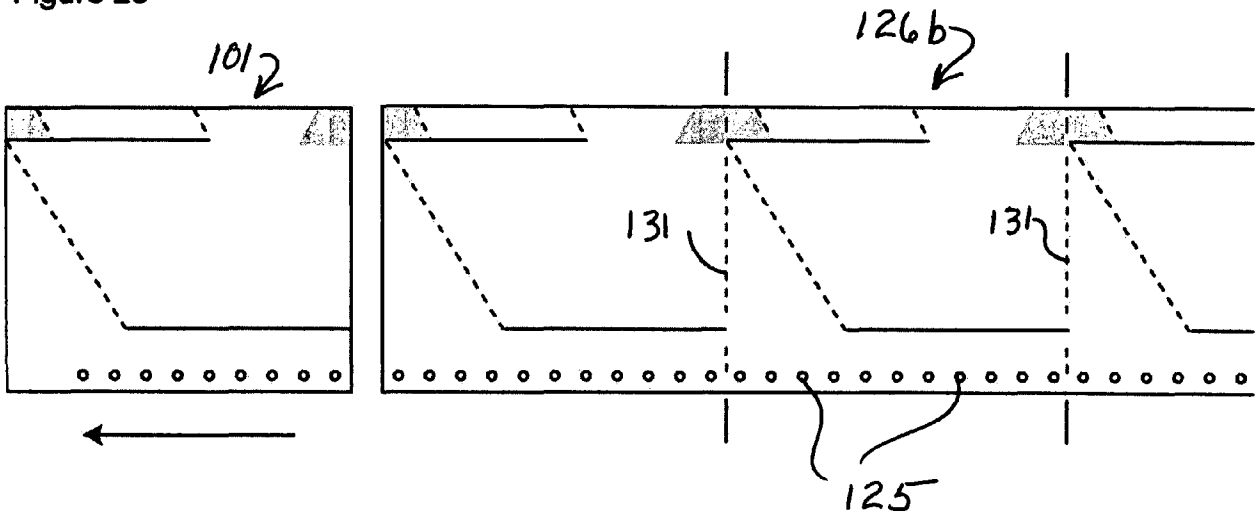
FIG. 29 shows the face side of the FIG. 25 piece "bursting" from the trailing strip of attached pieces.
Figure 30:
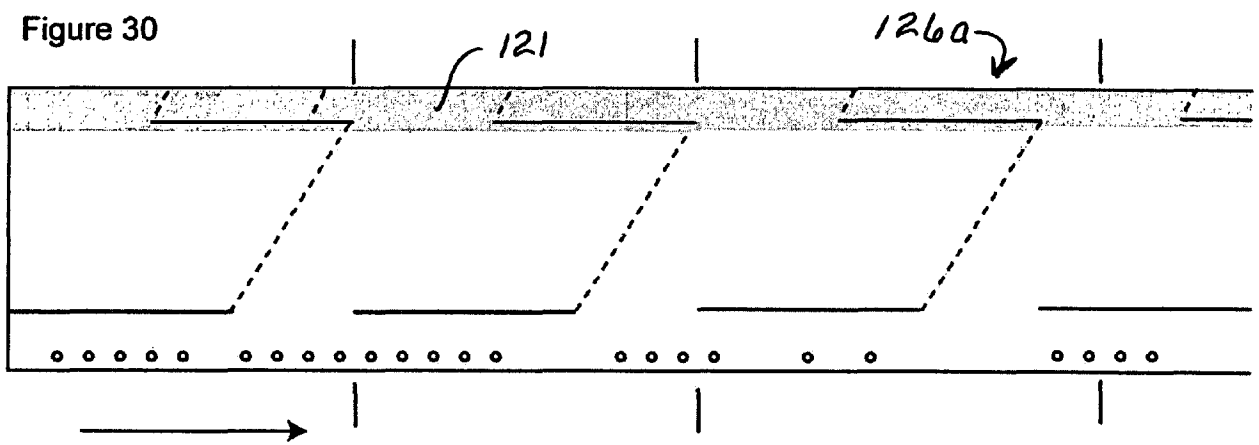
FIG. 30 shows the rear surface of the strip of FIG. 29 as it would appear prior to a subsequent fabrication step.
Figure 33:
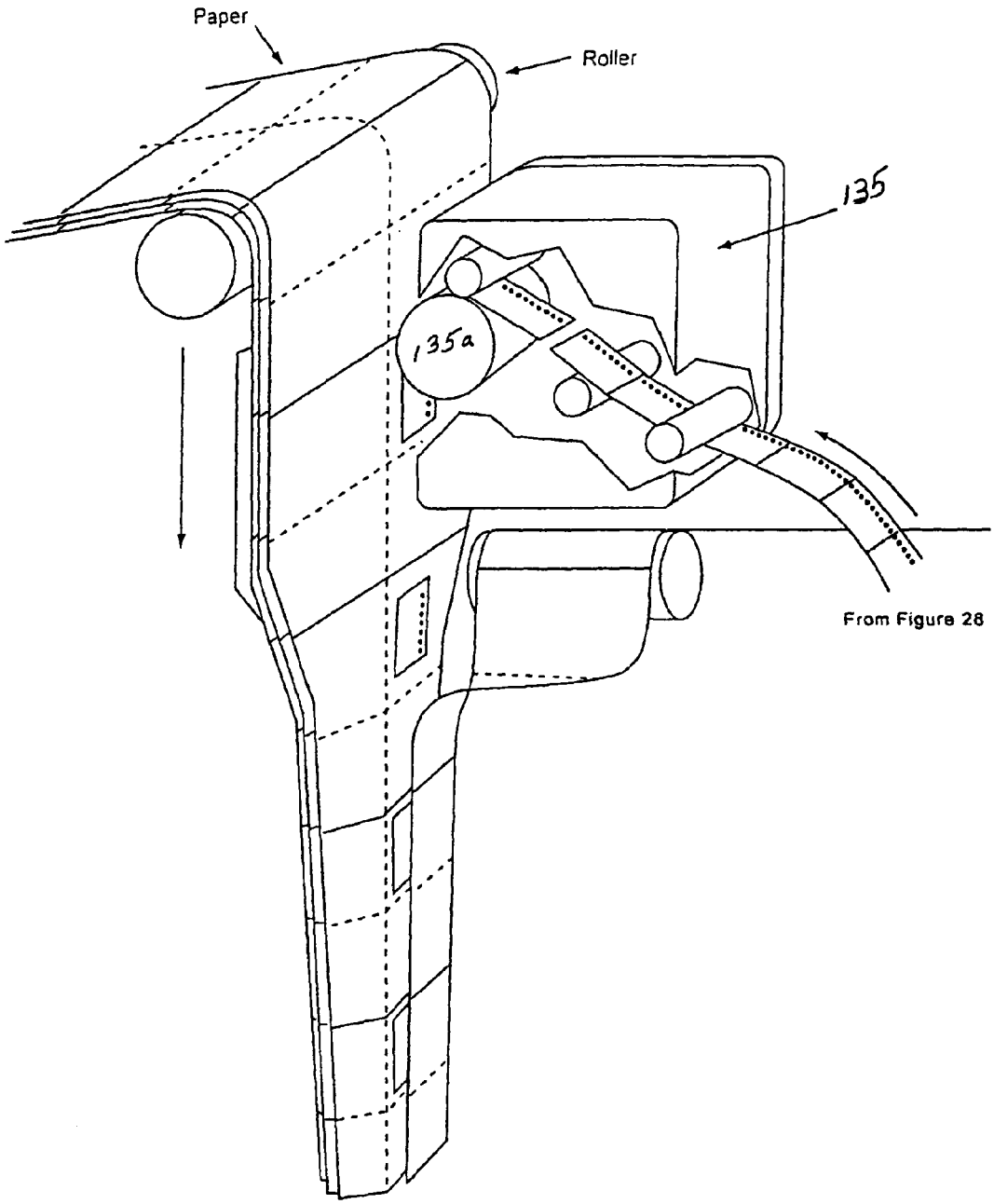
FIG. 33 is an enlarged view of a portion of FIG. 31 showing the former for forming/folding the printed webs coming from the turn bay/angle bar section of FIG. 32, which shows where the pop-up piece is placed onto the printed web as it passes through this former on its way to the web severer; however, only two ribbons are shown for simplification.
Figure 34:
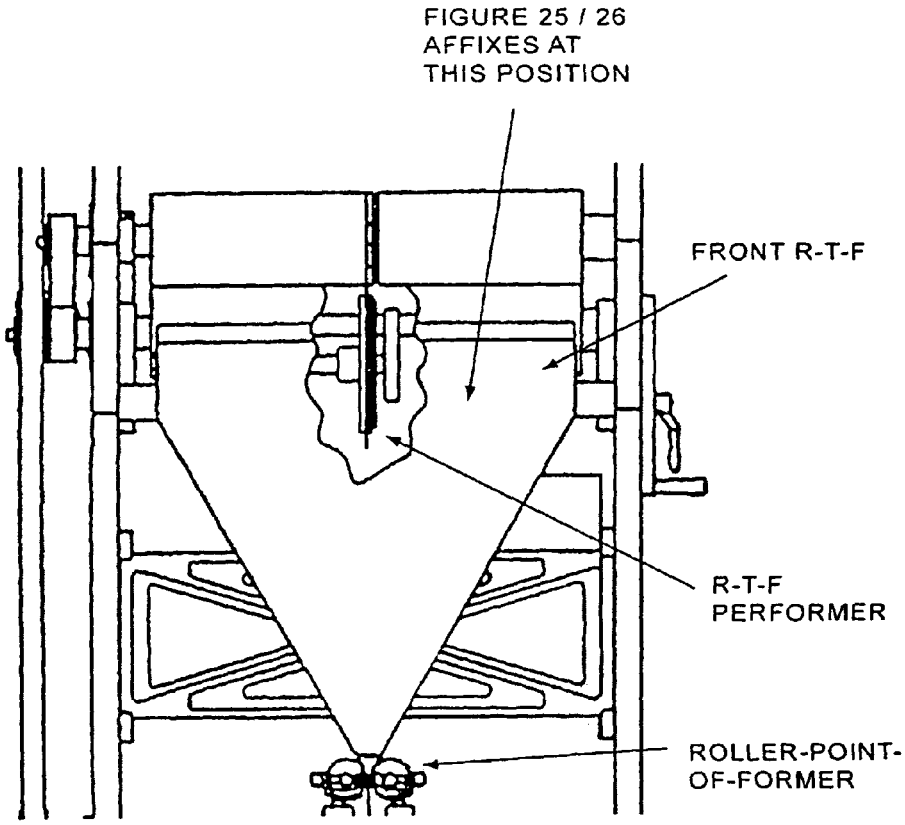
FIG. 34 is a schematic view showing the piece being burst from the strip, glued and affixed to the moving web.
Figure 35:
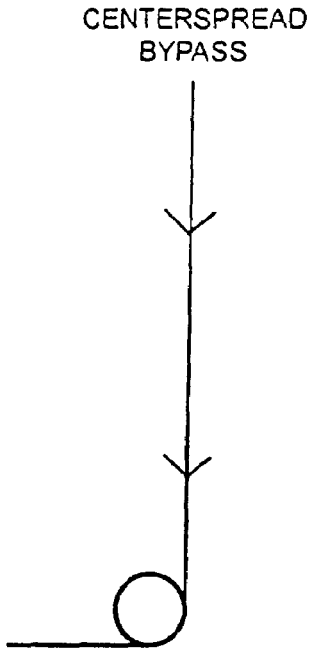
FIGS. 35 and 36 are schematic views, enlarged in size of additional sections from FIG. 31 showing where the center-spread of the magazine can bypass the other elements of a magazine while running on the press to facilitate placement of the single sheet pop-up piece before leaving the former rollers and entering the ribbon (web) severing where the web is cut into individual units.

As previously indicated, the unique pop-up strip design shown in FIG. 29 facilitates this high speed operation. The strips 126*b* of fan-folded pop-up pieces are fed from containers 127 as depicted in FIGS. 28 and 33 to the burster/placer/gluer 135 which is mounted adjacent the R-T-F performer, as best seen in the schematic drawing of FIG. 33. Because there are no die-cuts that reach the edges of the strip, it has the tensile strength to allow very high speed feeding without tearing or rupturing, even though the individual pieces are joined together at a line of perforations and even though the fan-folding at these lines of perforation 131 has conditioned the strip 126*b* to be easily separated into individual units. This separation is referred to in the art as "bursting," and it is depicted in FIG. 29 where the leading unit in the strip, that would be separated from the remainder of the strip in the burster, is shown apart from it. A strip of adhesive is applied to the undersurface of the piece, as shown in ghost outline in FIG. 26, in a region 139 generally parallel to the bottom edge but spaced just inwardly from the optional line of pinholes 125. Because this adhesive, which may be of the hot melt or any other suitable variety as well known in this art, can be applied at high speed to a piece moving in a straight line of travel, the adhesive application is facilitated by this design shown in FIGS. 29 and 30. The burster/placer 135 is designed to grasp the strip in regions that avoid contact with the pressure-sensitive adhesive pattern at the foot of the leg, so it does not come in contact with the machinery. A fast-rotating vacuum cylinder 135*a* may be used, the surface of which may be plasma-coated so that there will be no adherence at the pressure-sensitive adhesive. Accordingly, the now separated lead unit is placed onto the desired page of the fast-moving web within ⅛ inch of a desired location as shown in FIG. 33; moreover, by the time the next page reaches this location, the next pop-up piece in line has been conveyed to meet it.

Following this placement of the pop-up piece in the illustrated embodiment, there are now the six plys of the folded three-ply web assemblage traveling at high speed. Just beyond the location where the pop-up piece becomes affixed to the surface of this assemblage, there is substantially immediate engagement with the surface of the centerspread that is received from the bypass section and juxtaposed, as depicted in FIG. 31A.

Figure 36:
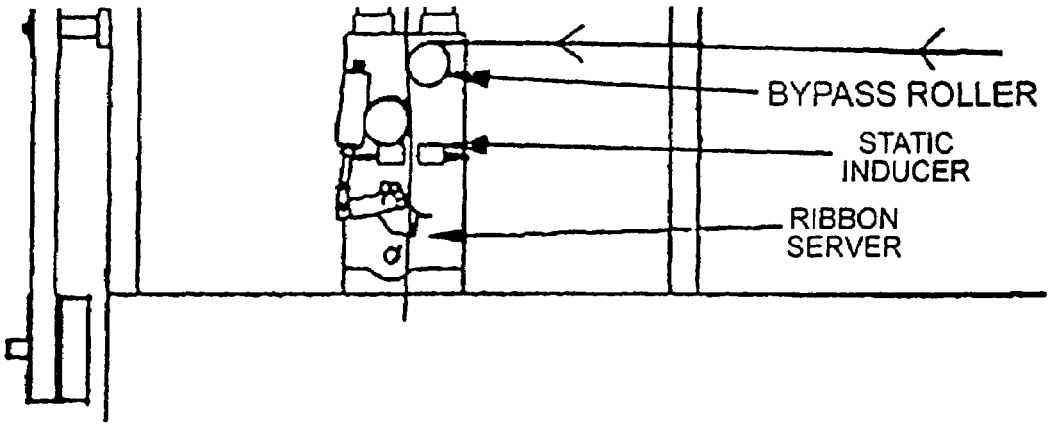
Figure 37:
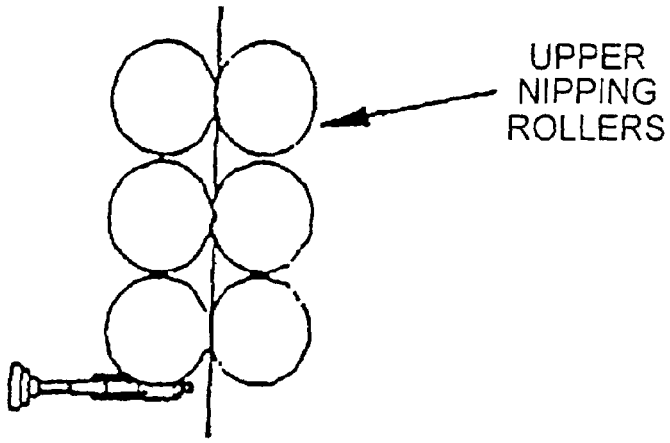
FIG. 37 is an enlarged view showing another section from FIG. 31, i.e., nipping rollers which convey the components to the area of final folding and delivery.
Figure 38:
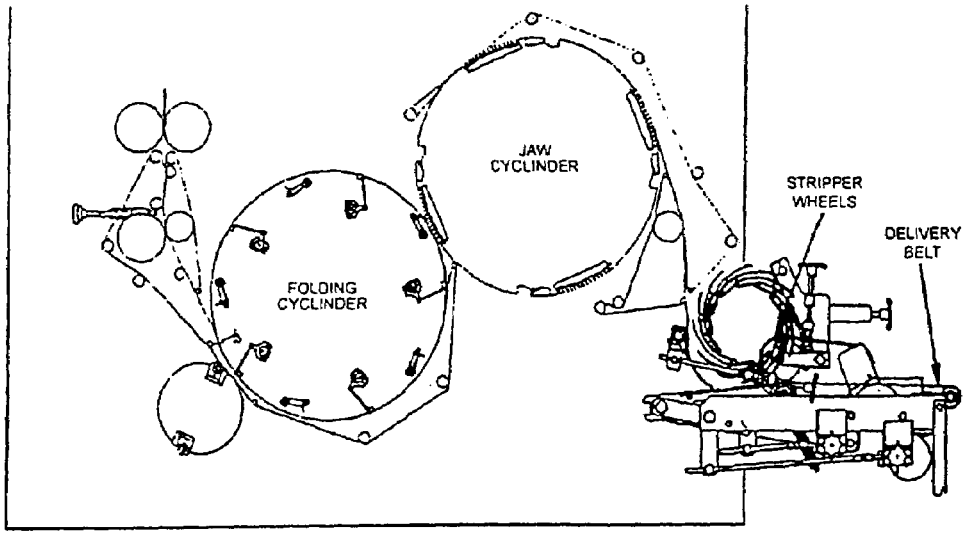
FIG. 38 is an enlarged view showing the area of final folding before entering the gathering area for delivery.

If the centerspread were supplied as a folded ribbon, it could have its fold lying adjacent the perforated edge of the folded three-ply assemblage, and such edge would then simply be trimmed by a ribbon server as depicted in FIG. 36. The upper nipping rollers apply compression to the assemblage, and this assures there is good contact both at the line of adhesive that was applied to the base section 109*a* of the pop-up piece and between the pressure-sensitive adhesive 123 on the foot and the facing page of the magazine.

Figure 39:
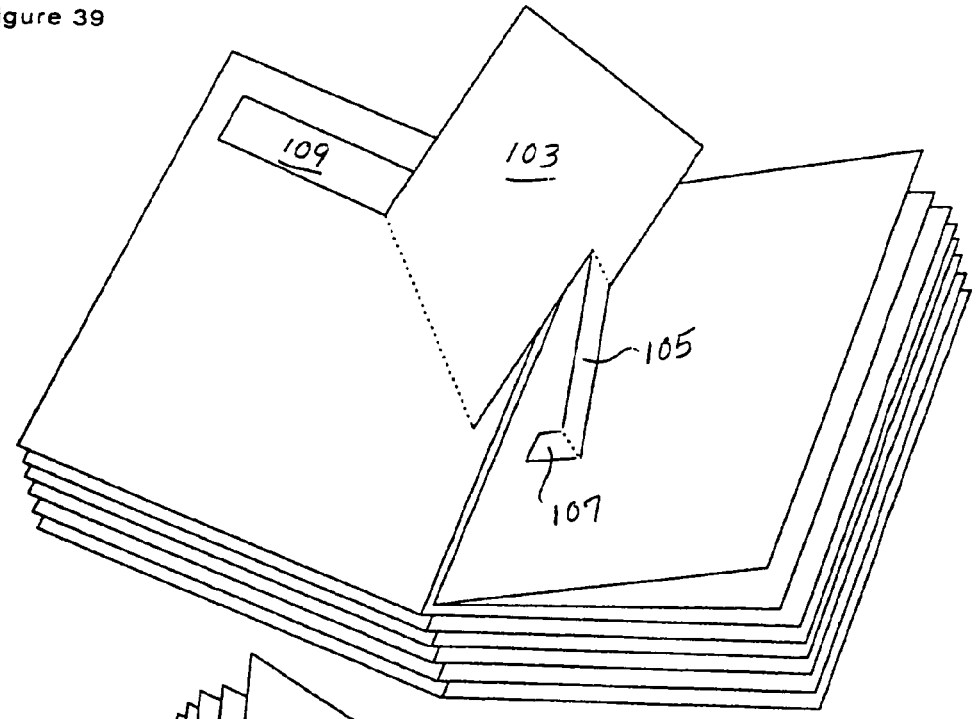
FIG. 39 shows a pop-up piece affixed to an even-numbered page of a magazine.
Figure 40:
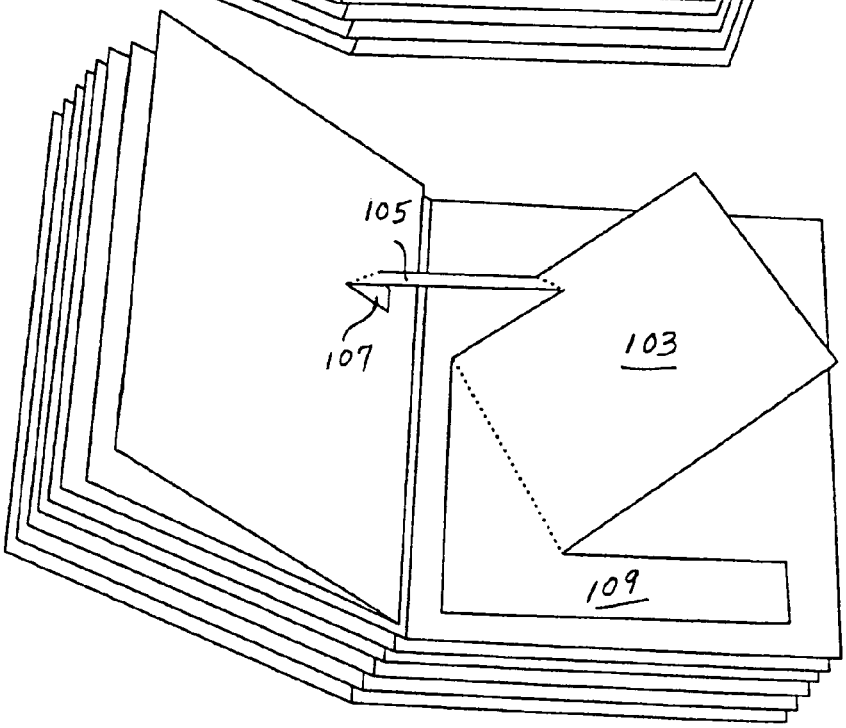
FIG. 40 shows a pop-up piece affixed to an odd-numbered page in the opposite orientation from that of FIG. 39.

Examples of how the pop up piece would appear in a final magazine are depicted in FIGS. 39 and 40, although it should be understood that fewer pages are shown than would be created in the four ribbon arrangement described hereinbefore (that would create a 28 page magazine). FIG. 39 depicts an arrangement where the base portion 109 of the pop-up piece 101 was affixed to an even-numbered page in the magazine, which was then covered by the centerspread that would provide the facing odd-numbered page. In this arrangement, as illustrated, the base 109 might be located near the upper edge of the even-numbered page, as a result of which the pressure-sensitive adhesive-carrying foot 107 would become affixed somewhere near the center of the facing odd-numbered page being supplied by the centerspread. When the recipient opens the magazine to these two pages, the attachment of the foot 107 to the odd-numbered page and the base 109 to the even-numbered page causes the pop-up piece to assume attention-attracting three dimensional shape displaying the flag panel 103 prominently. FIG. 40 illustrates an alternative arrangement where the base 109 is adhesively attached along the lower edge of an odd-numbered page and the foot 107 at the end of the leg 105 is attached by the pressure-sensitive adhesive pattern 123 to a region near the center of the facing even-numbered page. The final result is similar; when the recipient opens the magazine to these two pages, the base 109 and the foot 107 are pulled in opposite directions causing the pop-up piece to erect. The piece assumes attention-attracting three-dimensional shape, again prominently displaying the flag panel 103.

Figure 41:
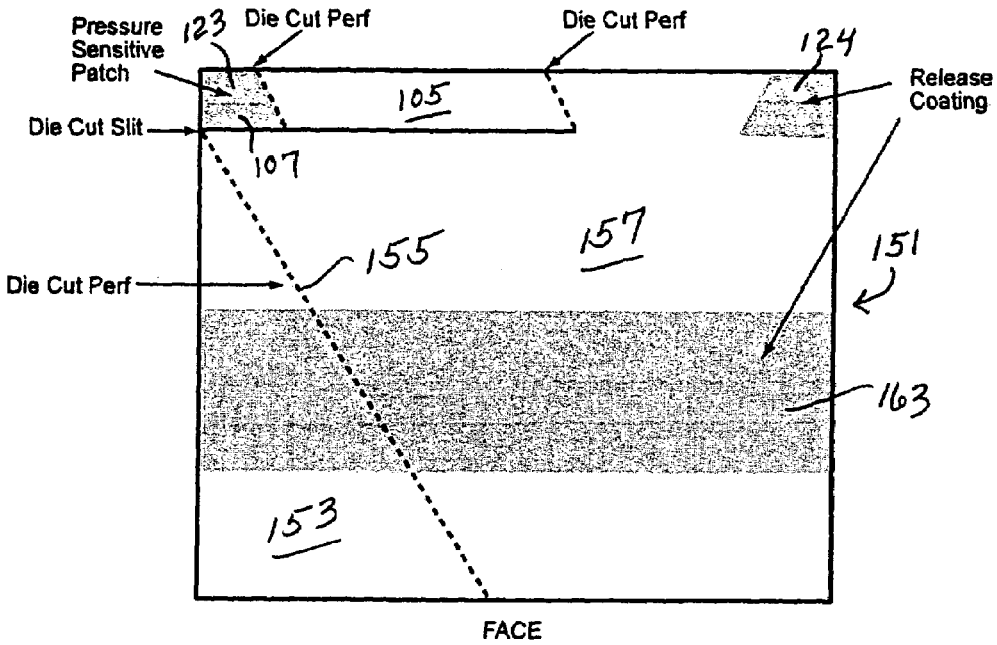
FIGS. 41 and 42 are drawings similar to FIGS. 25 and 26 showing an alternative version of a pop-up piece.
Figure 42:
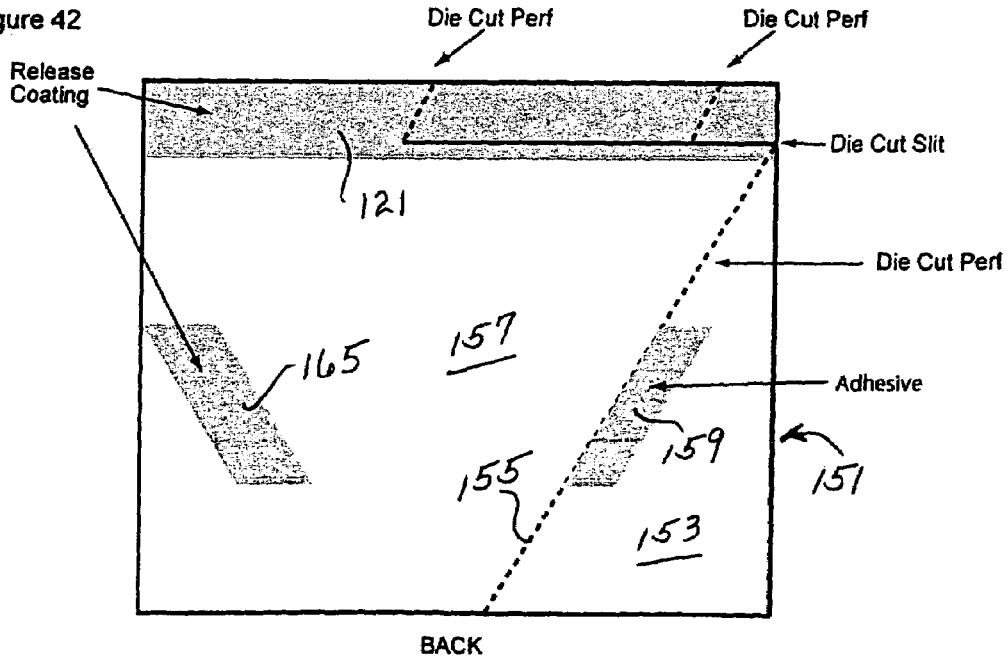

Illustrated in FIGS. 41 and 42 is an alternative version of a flat pop-up piece 151 which utilizes pressure-sensitive adhesive to affix the piece to both facing pages of the magazine. The pop-up piece 151 has only a single die-cut 115 that defines the leg at 105 as in the piece 101. It has a pair of lines of weakness, preferably in the form of die-cut perforations 117 and 119 that hinge the leg 105 to the remainder of the piece and create the foot 107. However, in this embodiment, the basel 53 has the shape of a triangle and is hinged along a line of weakness, preferably a line of die-cut perforations at 155, to the remainder of the piece which constitutes the flag panel 157. A first pattern 123 of pressure-sensitive adhesive is applied to the upper or face surface of piece 151 in the region of the foot 107 as before. A second pattern 159 of pressure-sensitive adhesive is applied to the rear surface in a generally central region of the base 153 preferably adjacent the line of weakness 155. To facilitate rolling the elongated strip of these pop-up pieces by coiling about itself, a strip of release coating of 121 is applied to the rear surface adjacent the side-edge where the leg 105 is disposed, as in the embodiment shown in FIG. 25. A second wider strip of release coating 163 is applied to the upper surface in the central region, where it will be in juxtaposition with the second adhesive patterns 159 in the roll form. Similarly, to permit the strip to be fan or Z-folded, a region 124 of release coating is applied to the face surface where it will interface with the pattern of pressure-sensitive adhesive 123, and a second pattern of release coating material 165 is applied to the rear surface where it will interface with the second pressure-sensitive adhesive pattern 163 in the fan-folded alignment.

Figure 43:
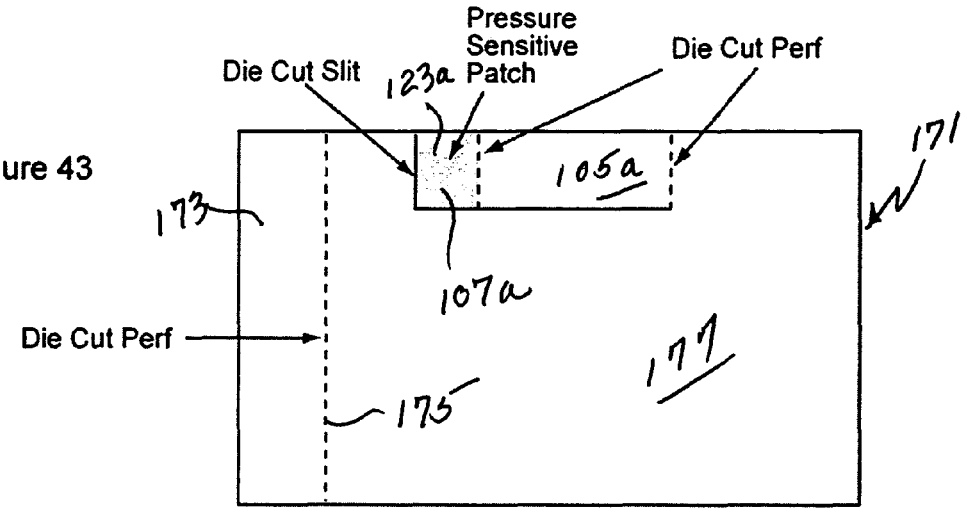
FIGS. 43, 44, and 45 are views of three additional alternative pop-up pieces similar to that shown in FIG. 25.

FIG. 43 is a view similar to FIG. 41 that illustrates another alternative embodiment of a pop-up piece design that may be utilized in respect to the present invention. Shown is a pop-up piece at 171 that is rectangular in shape and includes a leg 105*a* that has a foot 107*a* hinged at one end thereof, which is die-cut to lie generally centrally of one side edge of the piece. A base 173 is a formed at the one end thereof by a line of weakness 175 that extends perpendicularly across the width of the piece and the hinges the base 173 to the remainder of the piece which constitutes a flag panel 177. A pattern of pressure-sensitive adhesive 123*a* is applied to the surface of the foot. Preferably as part of the bursting and placing operation, a pattern of hot melt adhesive is applied to the rear or undersurface in the region of the base 173; alternatively, a pressure-sensitive adhesive pattern could be applied at the same time as adhesive pattern 123*a*, as explained in respect to the pop-up piece 151. Of course, similar patterns of release coating would be provided as previously explained, which are not shown herein.

Figure 44:
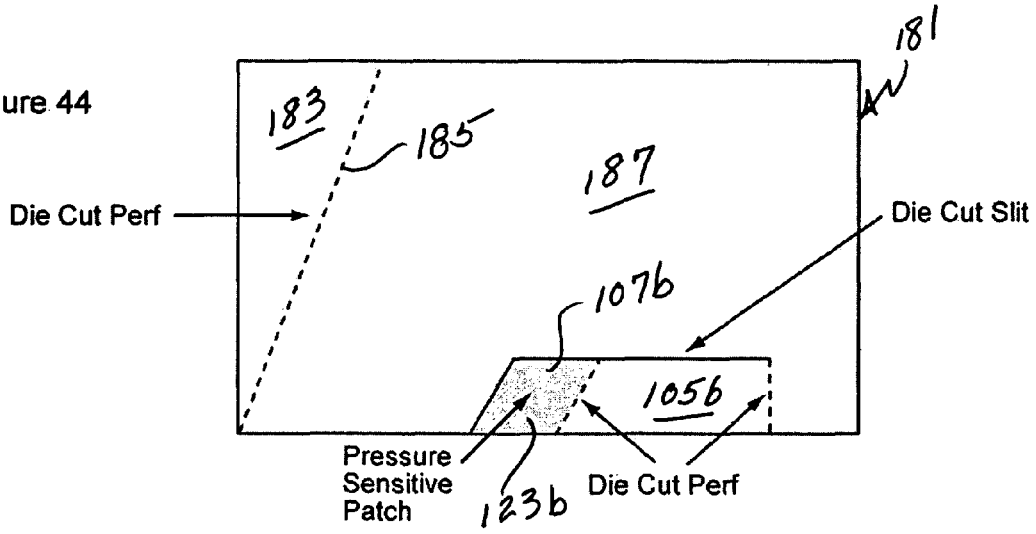

FIG. 44 illustrates still another pop-up piece design that might be employed in this invention. Shown is a rectangular piece 181 which includes a leg 105*b* die-cut along one side edge of the piece, which has a hinged foot 107*b* at one end and is hinged at the other end to the remainder of the piece. A triangular base section 183 is formed at one end of the rectangular piece by a line of weakness 185, along which the base is hinged to the remainder of the piece which constitutes the flag panel 187. As before, a pressure-sensitive adhesive pattern 123*b* is applied to the upper surface of the foot 107*b*, and an adhesive pattern is applied to the undersurface of the base 183 as mentioned just above with respect to piece 171. Patterns of release coating would likewise be appropriately applied to the upper surface and/or the undersurface of a strip of pieces 181 as described hereinbefore.

Figure 45:
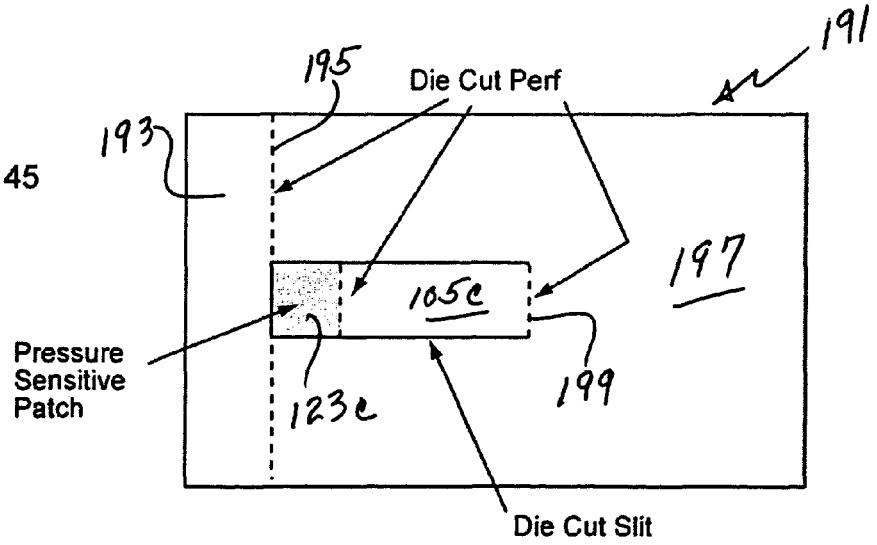

Illustrated in FIG. 45 is yet another pop-up piece design that could be employed in the present invention. Shown is a rectangular pop-up piece 191 wherein a leg 105*c* is die-cut at a location generally centrally of the piece. The leg has a hinged foot 107*c* at one end thereof which terminates at a base 193 that is further defined by a line of weakness 195 that extends across the piece from side edge to side edge and along which the base 193 is hinged to the remainder of the piece which constitutes a flag panel 197. The leg 105*c* is hinged at its opposite end to the flag panel along the hinge line 199, which is preferably parallel to the hinge line defining the foot 107*c*. A pressure-sensitive adhesive pattern 123*c* is similarly applied to the upper surface of the foot, and adhesive, either pressure-sensitive or hot melt, is applied to the undersurface of the base 193 as explained above with respect to the pop-up piece 171. The line of weakness 195 would not greatly reduce the strength of the paper in this region so that, when the strip is subjected to the bursting operation, the pop-up piece 191 will separate at the deep line of perforations about which the fan-folding of the strip would have previously occurred, and there will be no tearing at the location of the line of weakness 195.

Generally throughout the description of these various embodiments certain adhesives were mentioned; however, it should be understood that the particular adhesive chosen for a certain application is well within the ordinary skill of the art and that dry residue adhesive, light tack pressure-sensitive adhesive, strong tack pressure-sensitive adhesive, coadhesives, permanent adhesives, hot melt adhesives and the like can be alternatively employed as would fit a particular situation.

Although the invention has been described and illustrated with respect to certain preferred embodiments which constitute the best mode presently known for carrying out the invention, it should be understood that various changes and modifications as would be obvious to those having the ordinary skill in this art may be made without departing from the scope of the invention which is set forth in the claims appended hereto. For example, the invention is not limited to any particular type or grade of paper material, and in actuality any type of suitable sheet material, including thin plastic, that will readily receive printing may be employed. Magazines are intended to be broadly defined as including the normal magazines that are sold in bookstores and newsstands throughout the world and/or mailed to subscribers on a regular basis; however, they are also intended to include other such mass production assemblages that are widely distributed, for example, as a part of Sunday newspapers, such as Parade magazine, the freestanding coupon-carrying inserts and individual retailer sales catalogs and the like. Although reference is made throughout the application to consecutively numbered pages, such is done simply for illustrative explanation; that is, the purpose is simply to identify pages that are pretargeted to face one another in the final assemblage. Accordingly, it should be understood that some advertisers may prefer the page number be omitted from a full-page advertisement or the like so it will appear on a page without a number that is predesignated to follow an associated page that is likely numbered, and such a combination of pages is considered to be the full equivalent of two consecutively numbered pages.

In any of the illustrated methods, two feeders operating at a slower speed could alternately feed pop-up pieces onto a moving web or collating line. The invention also facilitates providing personalized pop-up pieces in a magazine that will then be mailed to a specific subscriber by coordination with computer subscription addressing. The disclosures of all the previously mentioned U.S. patents are expressly incorporated herein by reference.

Particular features of the invention are emphasized in the claims that follow.

What is claimed is:

1. A method of making magazines which include a pop-up structure wherein a pop-up piece is operatively attached between facing pages, which method comprises:

printing a plurality of signatures on a web fed press, which signatures each include at least two pairs of consecutively numbered or designated pages which are designed for assembly to create a magazine, conveying said signatures along a path as a part of the assembly of a magazine, providing a plurality of similar flat pop-up pieces at a location adjacent said path, which pieces are die-cut single sheets and carry indicia relevant to advertising that appears on one of said consecutive pages and also carry pressure-sensitive adhesive on a front surface, said pieces being attached to one another in series as a strip with a line of weakness between adjacent pieces, bursting each said piece along the line of weakness from the following piece in said strip, placing one of said burst pieces upon a specific location on each specific page bearing such advertising as the signature including that page is traveling along said path, which location is spaced from any edge of said page by moving said burst piece in the same direction and at the same speed at which said signature is traveling, and adhesively securing a rear surface of a base section of said piece thereto, positioning an additional one of said signatures which contains a page that is consecutive with said specific page in juxtaposition therewith so that there is adherence thereto at the location of said pressure-sensitive adhesive, completing the assembly of said magazine, whereby said pop-up piece becomes adhesively attached between two facing consecutive pages to form a pop-up structure such that, when a recipient of the magazine opens same to spread said consecutive two pages, said pop-up piece assumes an attention-attracting three-dimensional configuration in direct association with said specific page having said relevant advertising printed thereupon.

2. The method of claim 1 wherein said piece carries said pressure-sensitive adhesive and a release coating at separate regions of said front surface and said pieces are fed from a Z-folded stack arrangement to a burster which grasps said strip in regions that avoid contact with said pressure-sensitive adhesive.

3. The method of claim 1 wherein each said piece has only a single die-cut slit which defines a leg along one edge thereof and which does not reach the edges of said strip.

4. The method of claim 3 wherein a region of pressure-sensitive adhesive is carried on the front surface of said leg, and wherein said continuous strip carries regions of release coating on the front and rear surfaces of each piece and is fed from a Z-folded stack arrangement to a device located along said path that effects the bursting and placing of said leading piece.

5. The method of claim 3 wherein said signatures are being moved at a lineal speed sufficient to allow placement and securing of over 50,000 of said pieces per hour.

6. The method of claim 3 wherein said piece is placed and adhesively secured in a manner to attach one piece to each said signature when said signatures are being moved at a lineal speed as high as 46 feet per second.

7. A method of making magazines which include a pop-up structure wherein a flat single-sheet pop-up piece is operatively attached between facing pages, which method comprises:

printing a plurality of signatures which each include at least two pairs of consecutively numbered or designated pages and which are designed for saddle assembly to create a magazine, at least one specific page of said pairs carrying particular advertising, conveying said signatures along a path as a part of ultimate saddle assembly of the magazine, at a location adjacent said path, providing a continuous strip that is formed of a plurality of flat single-sheet pop-up pieces, interconnected head-to-tail, which pieces carry indicia related to said particular advertising and carry pressure-sensitive adhesive on front and rear surfaces thereof, said pieces being attached to one another in series as a strip with a line of weakness between adjacent pieces, bursting each said piece along the line of weakness from the following piece in said strip, moving said burst piece into juxtaposition with said signatures being conveyed so said piece is traveling in the same direction, and adhesively securing one adhesive-bearing surface of one of said burst pieces at a specific location on the one page or the facing page consecutive therewith as that page is traveling along said path, positioning an additional one of said signatures which carries the other page of the two consecutive pages in juxtaposition therewith so that said other surface of said piece becomes attached thereto a result of adherence of said pressure-sensitive adhesive on the other surface of said piece, and completing the assembly of said magazine wherein all the signatures are folded about said additional signature, whereby said pop-up piece becomes adhesively attached between said two facing consecutive pages to form a pop-up structure such that, when a recipient of the magazine opens same to spread the two pages of said one pair, said pop-up piece assumes an attention-attracting three-dimensional configuration in association with the printed related advertising.

8. The method of claim 7 wherein said piece is secured to said one page at a location spaced from any edge thereof.

9. The method of claim 7 wherein said pieces in said continuous strip are stored in facing contact with one another and both said surfaces of each piece carry regions of release coating located to abut said pressure-sensitive adhesive on a facing piece.

10. The method of claim 9 wherein said continuous strip is fed from a Z-folded stack arrangement to a device located along said path that effects the bursting and placing of said leading piece.

11. The method of claim 7 wherein each said piece has only a single die-cut slit which defines a leg along one edge thereof and which does not reach the edges of said strip, wherein a region of pressure-sensitive adhesive is carried on the front surface of said leg and another region of pressure-sensitive adhesive is carried on the rear surface of said piece, wherein said continuous strip carries regions of release coating on the front and rear surfaces of each piece located to interface with said adhesive regions in either a roll format or a Z-folded stack arrangement.

12. A method of making magazines which include a pop-up structure wherein a pop-up piece is operatively attached between facing pages, which method comprises:

printing a plurality of double-paginated ribbons on a web fed press, each of which includes at least two pairs of consecutively numbered or designated pages which are designed for assembly to create a magazine, conveying said ribbons along a path as a part of the assembly of a magazine, providing a plurality of similar flat pop-up pieces at a location adjacent said path, which pieces that are die-cut single sheets which carry pressure-sensitive adhesive on a front surface and on a rear surface, said pieces being attached to one another in series as a strip with a line of weakness between adjacent pieces, bursting each said piece along the line of weakness from the following piece in said strip, placing one of said burst pieces upon a specific location on a specific page on one said ribbon as it is traveling along said path, which location is spaced from any edge of said page, by moving said burst piece in the same direction that said ribbon is traveling and adhesively securing a rear surface of a base section of said piece thereto, positioning an additional one of said ribbons which contains a page that is consecutive with said specific page in juxtaposition therewith so that there is adherence thereto at the location of said pressure-sensitive adhesive on said piece and, completing the assembly of said magazine, whereby said pop-up piece becomes adhesively attached between two facing consecutive pages to form a pop-up structure such that, when a recipient of the magazine opens same to spread said consecutive two pages, said pop-up piece assumes an attention-attracting three-dimensional configuration.

13. The method of claim 12 wherein said piece carries said pressure-sensitive adhesive and a release coating at separate regions of said front surface and of said rear surface and said pieces are fed from a Z-folded stack arrangement to a burster which grasps said strip in regions that avoid contact with said pressure-sensitive adhesive.

14. The method of claim 12 wherein each said piece has only a single die-cut slit which defines a leg along one edge thereof and which does not reach the edges of said strip.

15. The method of claim 14 wherein said piece has a line of weakness that defines a triangular base panel.

16. The method of claim 12 wherein each said piece has only a single die-cut slit which defines a leg along one edge thereof and which does not reach the edges of said strip, wherein a region of pressure-sensitive adhesive is carried on the front surface of said leg and another region of pressure-sensitive adhesive is carried on the rear surface of said piece, wherein said continuous strip carries regions of release coating on the front and rear surfaces of each piece located to interface with said adhesive regions in either a roll format or a Z-folded stack arrangement.

17. The method of claim 16 wherein said piece has a line of weakness that defines a triangular base panel, and wherein said other region of pressure sensitive adherence is located on said triangular base panel.

* * * * *